US008020986B2

(12) United States Patent
Tanahashi et al.

(10) Patent No.: US 8,020,986 B2
(45) Date of Patent: Sep. 20, 2011

(54) IMAGE RECORDING APPARATUS

(75) Inventors: Naokazu Tanahashi, Nagoya (JP); Takashi Ohama, Iwakura (JP); Wataru Sugiyama, Aichi-ken (JP); Noriyuki Kawamata, Nagoya (JP); Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 453 days.

(21) Appl. No.: 12/345,579

(22) Filed: Dec. 29, 2008

(65) Prior Publication Data

US 2009/0169280 A1 Jul. 2, 2009

(30) Foreign Application Priority Data

Dec. 27, 2007 (JP) ..... 2007-335618

(51) Int. Cl.
*B41J 2/01* (2006.01)

(52) U.S. Cl. ..... 347/104; 347/101; 271/264

(58) Field of Classification Search ..... 347/101, 347/104; 271/264
See application file for complete search history.

(56) References Cited

U.S. PATENT DOCUMENTS

| | | | | |
|---|---|---|---|---|
| 4,526,361 | A * | 7/1985 | DuBois | 271/186 |
| 6,032,949 | A * | 3/2000 | Ando | 271/225 |
| 6,341,835 | B1 * | 1/2002 | Ogawa et al. | 347/16 |
| 6,896,257 | B2 * | 5/2005 | Yamashita et al. | 271/242 |
| 7,341,293 | B2 * | 3/2008 | Tsai | 294/1.1 |
| 7,374,281 | B2 * | 5/2008 | Saito et al. | 347/104 |
| 7,527,346 | B2 * | 5/2009 | Izuchi | 347/16 |
| 2006/0023050 | A1 | 2/2006 | Nishiberi et al. | |

FOREIGN PATENT DOCUMENTS

| | | |
|---|---|---|
| JP | 2003-137444 A | 5/2003 |
| JP | 2006-036518 A | 2/2006 |

* cited by examiner

*Primary Examiner* — Julian Huffman
*Assistant Examiner* — Sharon A. Polk
(74) *Attorney, Agent, or Firm* — Baker Botts L.L.P.

(57) ABSTRACT

The image recording apparatus includes: a recording head; a re-feeding roller configured to re-feed a one-side recorded medium toward the recording head; and a flap provided on an upstream side of the re-feeding roller in a conveying direction of the one-side recorded medium. The flap extends from an upstream end to a downstream end in the conveying direction. The downstream end of the flap is closer to the re-feeding roller than the upstream end in the conveying direction. The flap is configured to support and introduce the one-side recorded medium to the re-feeding roller. A downstream end portion of the flap has: a first region opposing the re-feeding roller; and a second region except the first region. The downstream end portion has a cutout portion provided in at least a part of the second region.

7 Claims, 16 Drawing Sheets

IMAGE RECORDING APPARATUS

CROSS-REFERENCE TO RELATED APPLICATIONS

This application is based upon and claims priority from Japanese Patent Application No. 2007-335618 filed on Dec. 27, 2007, the entire contents of which are incorporated herein by reference.

TECHNICAL FIELD

The present invention relates to an image recording apparatus.

BACKGROUND

An image recording apparatus capable of recording images on both sides of a recording medium while the recording medium is conveyed is known. JP-A-2006-36518 (e.g., paragraphs 0018 and 0022 of this reference) describes a recording apparatus of this type which can print on both sides of a recording medium using a recording head.

In this recording apparatus, when a double-sided printing is performed, a U-turn feeding pressure plate provided in a cassette is moved upward toward a U-turn feed roller such that a recording medium placed on the U-turn feeding pressure plate press-contacts the U-turn feed roller. Consequently, an uppermost recording medium is fed by the U-turn feed roller toward a recording head, and then a front side of the recording medium is printed.

Thereafter, when a rear side of the recording medium is printed, the U-turn feeding pressure plate is moved downward, and a third sheet flapper is moved to a position opposing the U-turn feed roller. The recording medium having the front side printed is then conveyed and again fed toward the recording head by the U-turn feed roller, and then the rear side of the recording medium is printed. Accordingly, both sides of the recording medium are printed.

JP-A-2003-137444 (e.g., paragraphs 0020 and 0021 of this reference) describes a paper feeding device including a flapper. The flapper covers a substantially front half of a bottom surface of a paper feeding cassette and has an upper surface serving as a placing surface of a sheet. In this paper feeding device, a paper feeding roller is arranged above a front end of the flapper. Similar to the above-described recording apparatus, in the paper feeding device, the sheet placed on the flapper press-contacts the paper feeding roller, and an uppermost sheet is conveyed by the paper feeding roller.

SUMMARY

However, in the recording apparatus described in JP-A-2006-36518, when the recording medium having the front side printed is conveyed on the third sheet flapper and then is again fed toward the recording head by the U-turn feed roller, a jam may occur, that is, the recording medium jams between the third sheet flapper and the U-turn feed roller.

The problem is specifically described. When a front side of the recording medium is printed, a cockling of the recording medium may occur, that is, the recording medium is deformed to wrinkle along a width direction thereof. The cockling is caused, for example, when the recording medium having the front side printed is conveyed by rollers that are arranged along the width direction of the recording medium, the cockling occurs according to the intervals between adjacent rollers.

Although JP-A-2006-36518 does not describe a shape of the third sheet flapper in plan view, the flapper of JP-A-2003-137444 is configured to support an entire width of the sheet immediately before the sheet press-contacts the paper feeding roller.

Assuming that the third sheet flapper of JP-A-2006-36518 is formed similar to the plan shape of the flapper of JP-A-2003-137444, the third sheet flapper of JP-A-2006-36518 supports an entire width of the recording medium immediately before the recording medium having the front side printed press-contacts the U-turn feed roller.

Therefore, the cockling may occur in the recording medium having the front side printed. If the cockled recording medium is conveyed on the third sheet flapper and then is again fed toward the recording head by the U-turn feed roller, the height of the recording medium with respect to the U-turn feed roller is not stable because of the cockling of the recording medium. As a result, the jam occurs, that is, the recording medium jams between the third sheet flapper and the U-turn feed roller.

The present invention was made in consideration of the above circumstances, and an object thereof is to provide an image recording apparatus capable of suppressing a jam when a re-feeding roller feeds a one-side printed medium of which an image has been recorded on one side and capable of smoothly conveying the one-side printed medium.

According to an aspect of the invention, there is provided an image recording apparatus capable of recording images on both sides of a recording medium, said image recording apparatus comprising: a recording head configured to eject ink to the recording medium; a re-feeding roller configured to re-feed a one-side recorded medium toward the recording head, the one-side recorded medium of which an image has been recorded on one side by the recording head; and a flap provided on an upstream side of the re-feeding roller in a conveying direction of the one-side recorded medium, the flap extending from an upstream end to a downstream end in the conveying direction, the downstream end of the flap being closer to the re-feeding roller than the upstream end of the flap in the conveying direction, and the flap being configured to support and introduce the one-side recorded medium to the re-feeding roller, wherein a downstream end portion of the flap has: a first region opposing the re-feeding roller; and a second region except the first region in the downstream end portion, the downstream end portion having a cutout portion provided in at least a part of the second region.

DESCRIPTION

Figure 1:
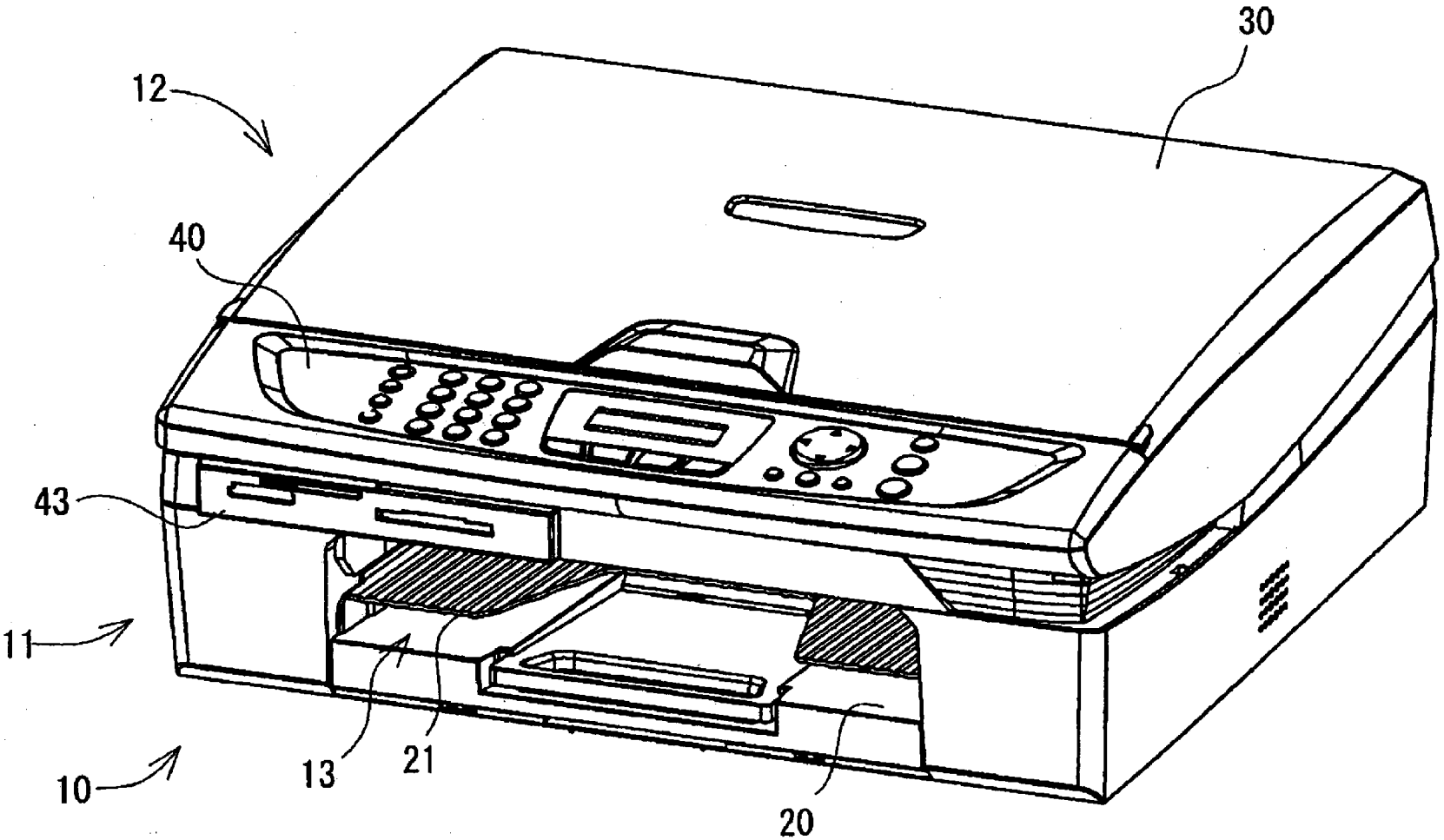
FIG. 1 is an external perspective view of a multi function device according to an embodiment of the invention.

Embodiments of the present invention are described with reference to the drawings. FIG. 1 is an external perspective view of a multi function device 10 according to one embodiment of the invention. The multi function device 10 includes a printer unit 11 of an inkjet type capable of recording images on both sides of a recording sheet serving as an example of a recording medium. Further, the multi function device 10 can suppress the jam when a feeding roller feeds a recording sheet of which an image has been recorded on one side and also can smoothly convey the recording sheet of which the image has been recorded on one side.

The multi function device 10 has various functions such as a telephone function, a facsimile function, a printer function, a scanner function and a copier function. The printing function contains a double-sided printing function which records images on both sides of the recording sheet.

The multi function device 10 includes: the printer unit 11 provided in a lower portion thereof; a scanner unit 12 provided in an upper portion thereof; an operation panel 40 provided in an upper front portion thereof; and a slot unit 43 provided in a front portion thereof.

The printer unit 11 has an opening 13 formed on a front portion thereof, and a feeding tray 20 and a discharge tray 21 are provided at two upper and lower stages and are partially exposed from the opening 13. The feeding tray 20 allows the recording sheets to be placed thereon. The recording sheet placed on the feeding tray 20 is fed into the printer unit 11, and after a desired image is recorded, the recording sheet is discharged on the discharge tray 21.

The scanner unit 12 is configured as a flat bed scanner. A document cover 30 is configured as an upper plate of the multi function device 10, and a platen glass (not shown) is provided below the document cover 30. A document is placed on the platen glass and read by the scanner unit 12 in a state in which the document is covered by the document cover 30.

The operation panel 40 is provided for operating various units such as the printer unit 11 and the scanner unit 12 and includes various operation buttons and a liquid crystal display unit. A user can set or operate the various functions by operating the operation panel 40. For example, the following settings can be instructed through the operation panel 40: for example, a setting for the type of the recording sheet (e.g., a plain paper or a postcard), a setting for a single-sided recording mode which allows an image to be recorded only a front side of the recording sheet, a setting for a double-sided recording mode which allows images to be recorded only both front and rear sides of the recording sheet, and a setting for resolution (e.g., a draft mode or a photo mode).

The slot portion 43 can mount various compact memory cards serving as storage media therein. For example, according to the user's operations to the operation panel 40 in a state in which the compact memory card is mounted in the slot portion 43, image date stored on the compact memory card can be read out, and the read out image data can be recorded on the recording sheet.

Figure 2:
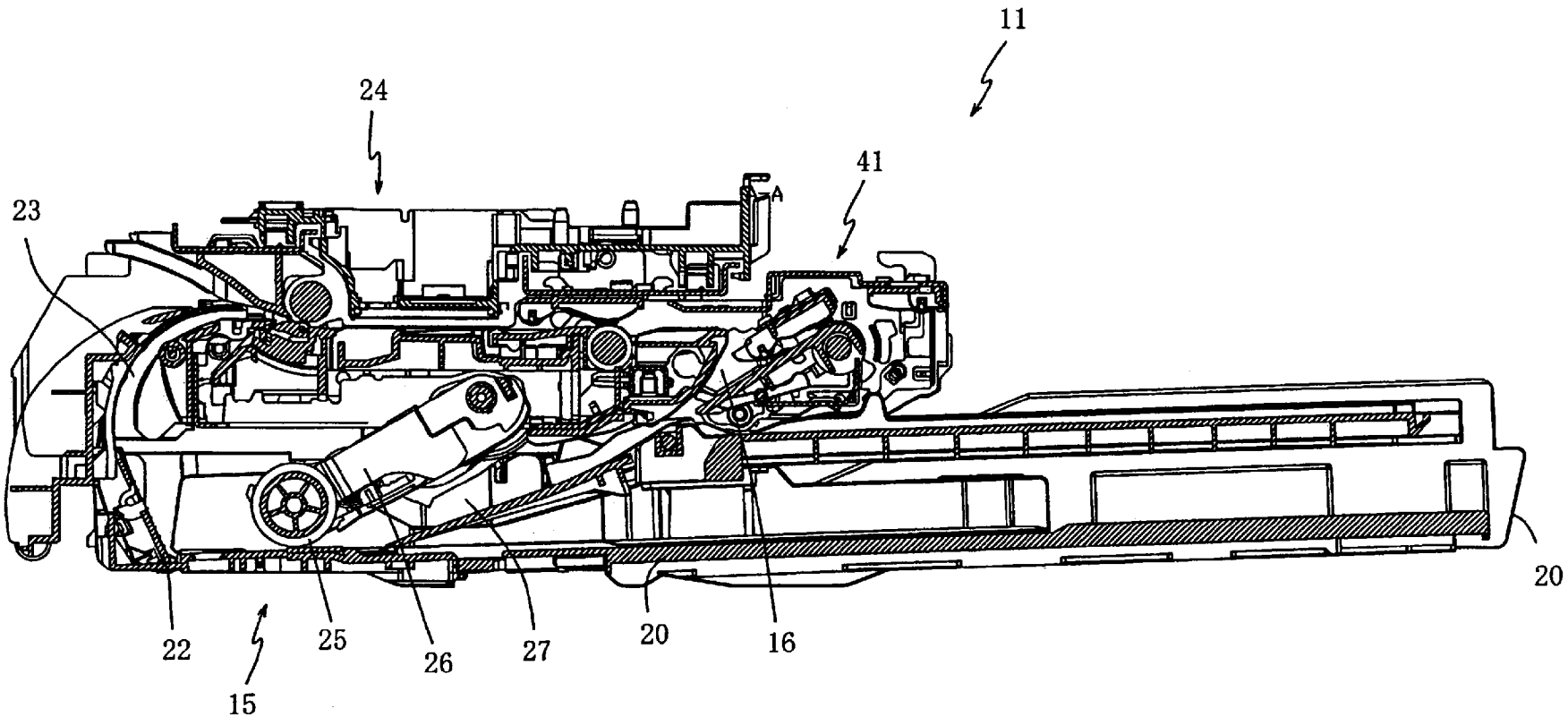
FIG. 2 is a vertical cross-sectional view of a printer unit of the multi function device.

Next, a schematic configuration of the printer unit 11 is described with reference to FIG. 2. FIG. 2 is a vertical cross-sectional view of a configuration of the printer unit 11. The printer unit 11 includes: a feeding portion 15 configured to feed the recording sheet; a conveying path 23 configured to convey the recording sheet fed from the feeding portion 15; a recording portion 24 configured to eject ink drops on the recording sheet conveyed through the conveying path 23 to record an image on the recording sheet; the discharge tray on which the recording sheet is discharged; a path switching unit 41 provided between the discharge tray 21 and the recording portion 24 and configured to switch a path so as to record an image on the rear side of the recording sheet; and a reverse guide portion 16 configured to guide the recording sheet of which a path has been switched by the path switching unit 41 to the feeding portion 15 side.

The feeding tray 20 is provided in the feeding portion 15 on which the recording sheets are placed. The feeding tray 20 is provided on a bottom side of the printer unit 11 and has a box shape having a top opened. The recording sheet placed on the feeding tray 20 is fed to the conveying path by a feeding roller 25.

When an image is record on only one side (front side) of the recording sheet, the recording sheet fed by the recording sheet is guided to U-turn from a lower side to an upper side along the conveying path 23 and reaches the recording portion 24. Then, after the image is recorded on the front side of the recording sheet by the recording portion 24, the recording sheet is discharged on the discharge tray 21.

On the other hand, when images are recorded on both sides (front and rear sides) of the recording sheet, a recording sheet of which an image has been recorded on the front side is guided by the path switching unit 41 to the reverse guide portion 16 such that the front side of the recording sheet contacts the feeding roller 25. Then, the recording sheet is again fed to the conveying path 23 by the feeding roller 25, and after the image is recorded on the rear side of the recording sheet by the recording portion 24, the recording sheet is discharged on the discharge tray 21.

Figure 3:
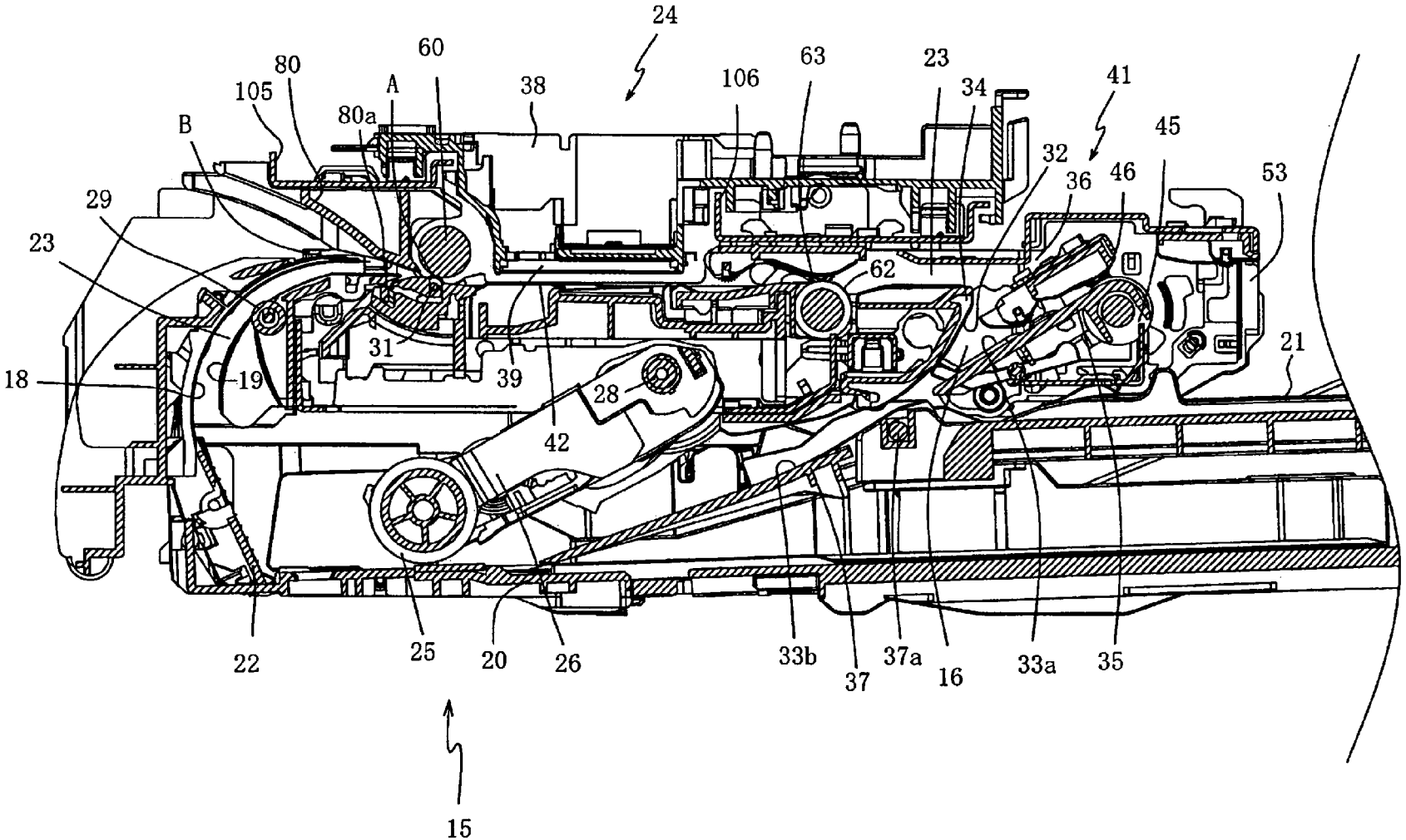
FIG. 3 is a partial enlarged view of the printer unit.

Next, the configuration of the printer unit 11 is described in detail with reference to FIG. 3. FIG. 3 is a partial enlarged cross-sectional view of the printer unit 11.

The feeding roller 25 is disposed above the feeding tray 20 in the feeding portion 1. The feeding roller 25 is configured to feed the recording sheet placed on the feeding tray 20 to the conveying path 23 and is rotatably supported by a distal end of a feeding arm 26. The feeding roller 25 is rotation-driven through a power transmission mechanism provided in the feeding arm 26 and including a LF motor 71 (see FIG. 11) as a driving source. The power transmission mechanism includes linearly arranged gears that are provided in the feeding arm 26 and meshes with one another.

The feeding arm 26 has a base end portion supported by an axis 28 and is rotatable around the axis 28 as a rotation axis. Accordingly, the feeding arm 26 can vertically move to and away from the feeding tray 20. The feeding arm 26 is rotationally urged downward by its own weight or by an urging member such as a spring. Accordingly, the feeding arm 26 is normally contacts the feeding tray 20 and is retracted upwardly when the feeding tray 20 is inserted and pulled out.

When the recording sheet is fed from the feeding tray 20, since the feeding arm 26 is rotationally urged downward, the feeding roller 25 is rotated in a state in which the feeding roller 25 press-contacts the recording sheet placed on the feeding tray 20. Accordingly, by a frictional force generated between a roller surface of the feeding roller 25 and the recording sheet, an uppermost recording sheet of a sheet stack is fed to a separation inclined plate 22.

When a leading end of the recording sheet contacts the separation inclined plate 22, the recording sheet is guided upward and fed into the conveying path 23. When the uppermost recording sheet is fed by the feeding roller 25, a recording sheet immediately below the uppermost recording sheet may also be fed by the action of friction or static electricity but held by a contact with the separation inclined plate 22.

The conveying path 23 is formed to extend upward from the separation inclined plate 22 and then bend in U-shape toward front. Thereafter, the conveying path 23 extends from a rear side of the multi function device 10 (a left side in FIG. 3) to a front side thereof (a right side in FIG. 3), and reaches the discharge tray 21 through the recording portion 24.

The conveying path 23 is defined between an outer guide surface and an inner guide surface in a region other than a region where the recording portion 24 etc. is provided. For example, an outer guide surface 18 and an inner guide surface 19 is provided in a curved portion of the conveying path 23 on a rear side of the multi function device 10 such that the outer guide surface 18 opposes the inner guide surface 19 with a predetermined interval therebetween.

A guide 80 is disposed between a most downstream portion the outer guide surface 18 and the conveying roller 60 (described later in detail), a part of an outer line of the conveying path 23 is defined by a guide surface 80*a* as one surface of the guide 80.

The guide surface 80*a* contacts the recording sheet fed from the feeding roller 25 through the curved portion of the conveying path 23 and is configured to introduce the recording sheet to a press-contact position A between the conveying roller 60 and a pinch roller 31. The guide surface 80*a* has an inclined surface which is inclined downward from outside of the most downstream end portion of the outer guide surface 18 toward the press-contact position A between the conveying roller 60 and the pinch roller 31.

In addition, as described later in detail, when the recording sheet is conveyed by both the feeding roller 25 and the conveying roller 60, the LF motor 71 (see FIG. 11) is controlled such that a conveying velocity of the feeding roller 25 is larger than a conveying velocity of the conveying roller 60. Consequently, a conveying load at the conveying roller 60 is reduced, and slipping occurred at the conveying roller 60 is suppressed.

According to this control, the recording sheet is conveyed in the curved portion of the conveying path 23 along the outer guide surface 18 side, contacts the guide surface 80*a*, and is conveyed along the guide surface 80*a* toward the press-contact position A between the conveying roller 60 and the pinch roller 31. That is, a conveying direction of the recording sheet is regulated such that the recording sheet enters toward the press-contact position A between the conveying roller 60 and the pinch roller 31. Consequently, the recording sheet is stably conveyed to a platen 42, and the recording sheet is prevented from floating on the platen 42. Accordingly, it is possible to prevent: the jam of the recording sheet occurring between the recording head 39 and the platen 42; the stain of the recording sheet caused by contacting the recording head 39; and the deterioration of the recording quality caused by the uneven interval between the recording head 39 and the recording sheet.

Further, the guide surface 80*a* has the inclined surface which is inclined downward from the outside of the downstream end portion of the outer guide surface 18 toward the press-contact position of the conveying roller 60 and the pinch roller 31, and the guide 80 defining the guide surface 80*a* is formed by a separate member from a member defining the outer guide surface 18. Therefore, in case where the conveying roller 60 is driven after a threshold time period elapses from when the leading end of the recording sheet reaches the conveying roller 60 in order to adjust an oblique conveyance of the recording sheet, the recording sheet is bent to an upstream side of the conveying direction. However, a buckling space for absorbing the bend is easily secured by a space B defined between the upstream end portion of the outer guide surface 18 and the guide 80.

In a curved portion of the conveying path 23, a roller 29 is provided. The roller 29 is rotatable, and a roller surface of the roller 29 is exposed from the inner guide surface 19. Therefore, even at the curved portion of the conveying path 23, the recording sheet is smoothly conveyed.

On an upstream side of the conveying roller 60 in the conveying path 23, the registration sensor 102 (see FIG. 11) is provided. The registration sensor 102 includes a detector element and an optical sensor, ant the detector element is disposed across the conveying path 23 such that the detector element can protrude into and retracted from the conveying path 23. The detector element is always elastically urged to protrude into the conveying path 23, and when the recording sheet conveyed on the conveying path 23 contacts the detector element, the detector element is retracted from the conveying path 23. Based on the protrusion and retraction of the detector element, the optical sensor is switched ON/OFF. Accordingly, the leading end and/or trailing end of the recording sheet can be detected in the conveying path 23 depending on the protrusion and the retraction of by the detector element.

The recording portion 24 is disposed midway of the conveying path 23 and includes a carriage 38 and the recording head 39. The recording head 39 is mounted on the carriage 38 and configured to reciprocate along guide rails 105, 106 in a main scanning direction (a direction perpendicular to a sheet face of FIG. 3).

Specifically, a CR motor 95 (see FIG. 11) is provided as a driving source of the carriage 38, and the carriage 38 is slid by, for example, a belt driving mechanism. In an inside of the multi function device 10, an ink cartridge (not shown) is disposed independently of the recording head 39. Ink is supplied from the ink cartridge to the recording head 39 via an ink tube. During the reciprocation of the carriage 38, minute ink drops formed from the ink are ejected from the recording head 39. Consequently, an image is recorded on the recording sheet conveyed on the platen 42.

At a main body frame 53 of the multi function device 10, a linear encoder 85 (see FIG. 11) configured to detect a position of the carriage 38 is provided. An encoder strip of the linear encoder 85 is provided at the guide rails 105, 106. The encoder strip includes: a light transmitting portion through which light can be transmitted; and a light blocking portion which blocks the light. The light transmitting portion and the light blocking portion are alternately disposed in a longitudinal direction of the encoder strip to form a predetermined pattern.

On an upper surface of the carriage 38, an optical sensor as a transmission type sensor is provided. The optical sensor is disposed at a position corresponding to the encoder strip, and is configured to reciprocate together with the carriage 38 in the longitudinal direction of the encoder strip so as to detect the pattern of the encoder strip during the reciprocation.

Further, a media sensor 86 (see FIG. 11) is provided at the carriage 38 and configured to detect a presence or absence of the recording sheet on the platen 42. The media sensor 86 includes a light source and a light receiving element. The light emitted from the light source is irradiated to the recording sheet conveyed on the platen 42, whereas the light is irradiated to the platen 42 when the recording sheet is not conveyed on the platen 42. The light irradiated to the recording sheet or the platen 42 is reflected, and the light receiving element receives the reflected light and outputs a signal depending on an amount of the received light.

The conveying roller 60 and the pinch roller 31 are provided on an upstream side of the recording portion 24 in the conveying path 23. The conveying roller 60 and the pinch roller 31 nip the recording sheet conveyed on the conveying path 23 and then send the recording sheet to the platen 42. The conveying roller 60 and the pinch roller 31 are paired, and the pinch roller 31 is disposed so as to press contact a lower side of the conveying roller 60 such that the press-contact position A is located above the platen 42.

That is, an extension line of the guide surface 80*a* passes through the press-contact position A of the conveying roller 60 and the pinch roller 31 and intersects with the platen 42. Therefore, the recording sheet conveyed along the guide surface 80*a* through the conveying roller 60 and the pinch roller 31 can be conveyed without floating on the platen 42.

On a downstream of the recording portion 24 in the conveying path 23, a discharge roller 62 and a spur roller 63 are provided. The discharge roller 62 and the spur roller 63 are configured to nip and convey the recording sheet on which the image has been recorded from the conveying path 23 to a further downstream side in the conveying direction (to the discharge tray 21 side).

The conveying roller 60 and the discharge roller 62 is driven by the LF motor 71 (see FIG. 11) as the driving source thereof. The drives of the conveying roller 60 and the discharge roller 62 are synchronized. The conveying roller 60 and the discharge roller 62 are intermittently driven at a time of the image recording. Accordingly, the image recording is performed while the recording sheet is conveyed by a linefeed width.

At the conveying roller 60, a rotary encoder 87 (see FIG. 11) is provided. The rotary encoder 87 includes an optical sensor configured to detect a pattern on an encoder disk (not shown) rotatable together with the conveying roller 60. The rotation of the conveying roller 60 and the discharge roller 62 are controlled based on a signal detected by the optical sensor. The conveying roller 60 and the discharge roller 62 are continuously driven, which allows a quick sheet conveyance.

The spur roller 63 is configured to press contact the recording sheet on which the image has been recorded. On the roller surface of the spur roller 63, protrusions and recesses are provided in a spur manner so as to prevent the image recorded on the recording sheet from deteriorating. The spur roller 63 is slidable in a direction toward and away from the discharge roller 62, and is urged to press-contact the discharge roller 62. A coil spring is typically used for an urging member that urges the spur roller 63 to the discharge roller 62.

Although not shown in FIG. 3, a plurality of the spur rollers 63 are provided in this embodiment, and the spur rollers 63 are arranged at equal intervals along a direction perpendicular to a conveying direction of the recording sheet, i.e., a width direction of the recording sheet. Eight spur rollers 63 are provided in this embodiment, but the number of the spur rollers is not limited thereto.

When the recording sheet enters between the discharge roller 62 and the spur roller 63, the spur roller 63 retracts against an urging force of the coil spring by a thickness of the recording sheet. Accordingly, the recording sheet is press-contacted by the discharge roller 62, and a rotation force of the discharge roller 62 is reliably transmitted to the recording sheet. Further, the pinch roller 31 is also elastically urged to the conveying roller 60. Accordingly, the recording sheet is press-contacted by the conveying roller 60, and a rotation force of the conveying roller 60 is reliably transmitted to the recording sheet.

In the recording sheet of which an image has been recorded on the front side by the recording head 39, the deformation to wrinkle along the width direction of the recording sheet, i.e., cockling, may occur due to the ink ejected from the recording head 39 when the recording sheet passes between the discharge roller 62 and the spur roller 63.

Figure 4:
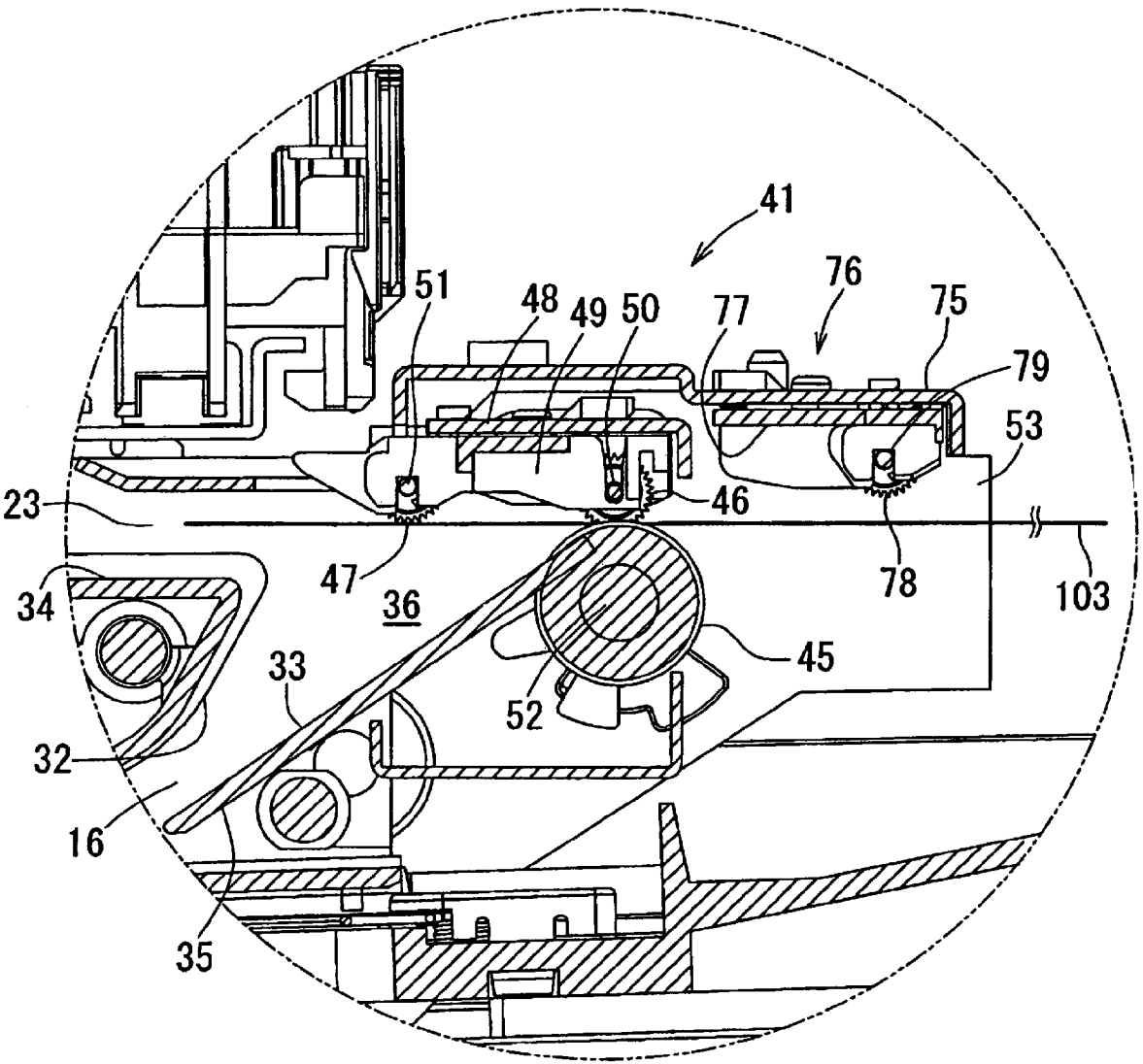
FIG. 4 is an enlarged cross-sectional view of a path switching unit.
Figure 5:
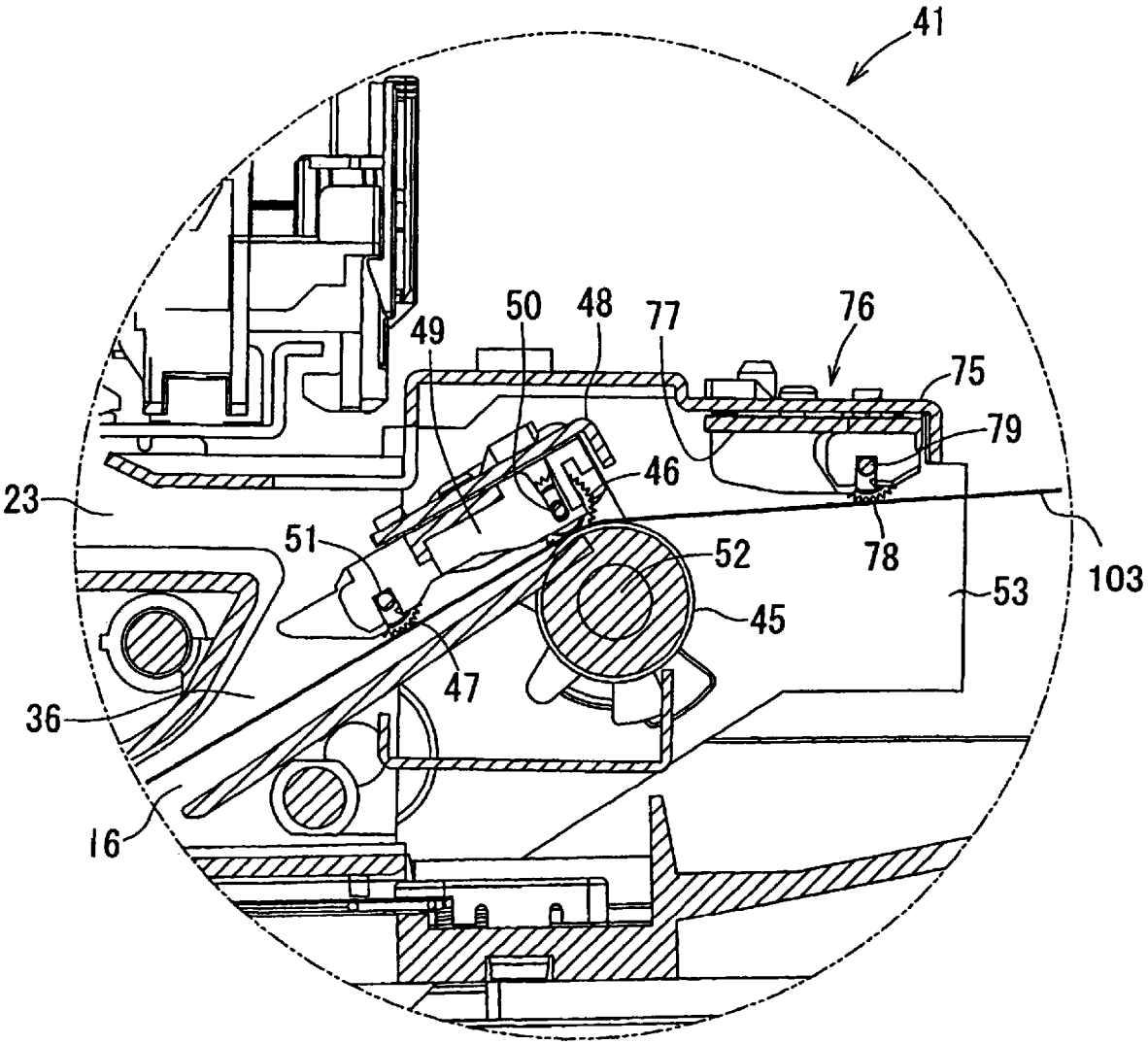
FIG. 5 is an enlarged view of the path switching unit.

At a downstream side of the discharge roller 62 and the spur roller 63, the path switching unit 41 is provided. The path switching portion 41 is described with reference to FIGS. 4 and 5. FIGS. 4 and 5 are enlarged cross-sectional views of the path switching unit 41, and FIG. 5 shows a state in which the path switching unit 41 has rotated around a center axis 52 serving as a rotation center from a state shown in FIG. 4.

The path switching unit 41 is provided on the downstream side of the recording portion 24. Specifically, the path switching unit 41 is disposed in a downstream portion 36 of the recording portion 24 in the conveying path 23. In other words, the path switching unit 41 is disposed in a downstream portion of a boundary portion between the conveying path 23 and the reverse guide portion 16 in the conveying direction. The path switching unit 41 includes: a first roller 45 and a second roller 46 which form a roller pair; and an auxiliary roller 47.

The first roller 45 and the second roller 46 are configured to nip the recording sheet 103 conveyed from the discharge roller 62 and the spur roller 63. The first roller 45 and the second roller 46 can convey the recording sheet 103 along the conveying path 23 to further downstream side in the conveying direction (the discharge tray 21 side), and also can convey the recording sheet to the reverse guide portion 16.

The second roller 46 and the auxiliary roller 47 are attached to a frame 48. The frame 48 extends in right and left directions of the multi function device 10 (a direction perpendicular to a sheet face of FIG. 3) (see FIG. 6). A cross-sectional shape of the frame 48 has a substantially L-shape, which ensures desired bending rigidity of the frame 48.

Figure 6:
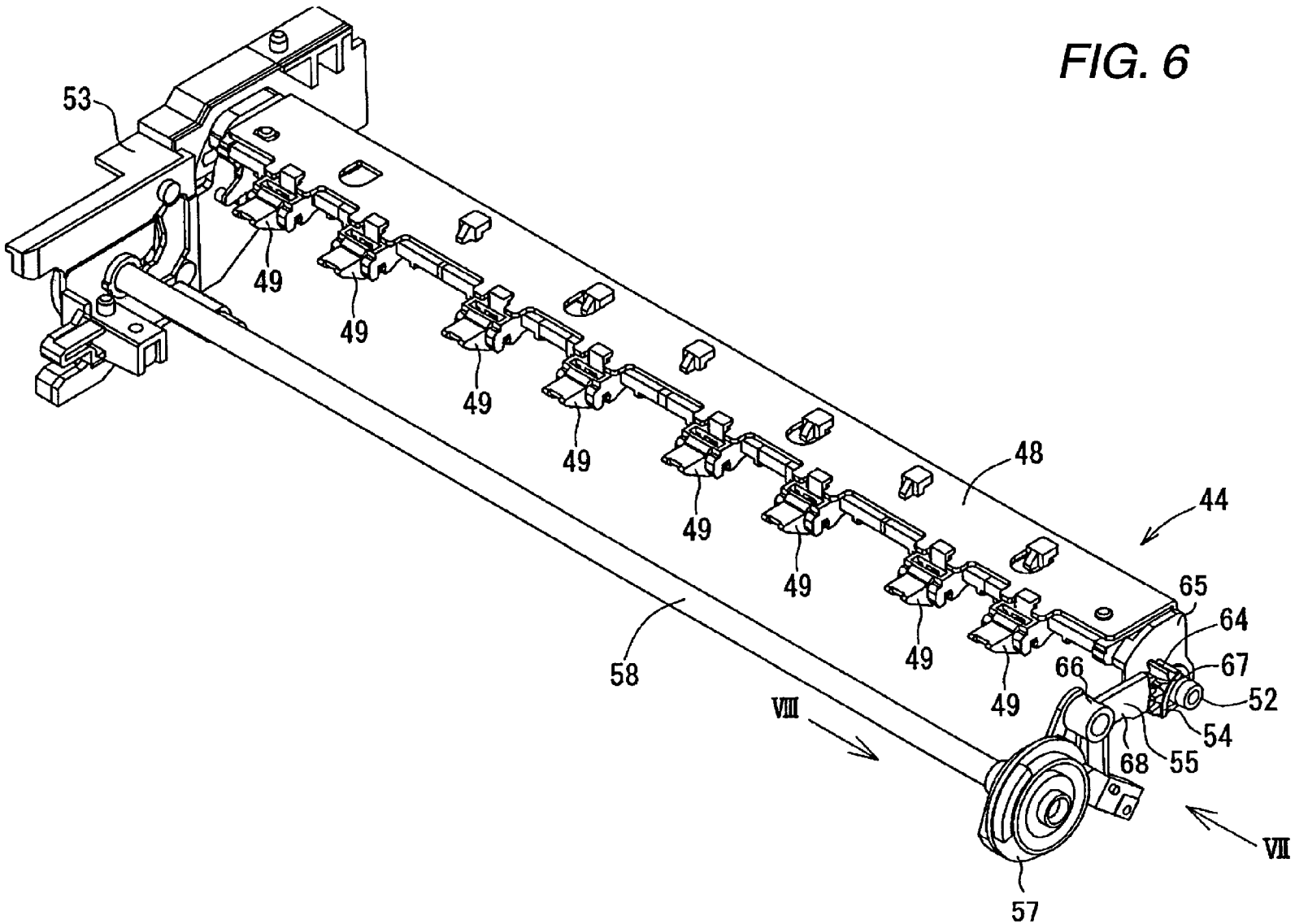
FIG. 6 is a perspective view of the path switching unit.

The frame 48 includes eight subframes 49 integrally provided thereto (see FIG. 6). The subframes 49 are disposed symmetric with respect to a center of the multi function device 10 along the right and left directions. Each of the subframes 49 rotatably supports one second roller 46 and one auxiliary roller 47. Therefore, the frame 48 includes eight second rollers 46 and eight auxiliary rollers 47. The second rollers 46 and the auxiliary rollers 47 are disposed at equal intervals in a direction perpendicular to the conveying direction of the recording sheet, i.e., the width direction of the recording sheet 103.

The second roller 46 and the auxiliary roller 47 are supported by and rotatable around supporting axes 50, 51 provided at each of the subframe 49, respectively. In this embodiment, the second roller 46 and the auxiliary roller 47 have a super shape. The auxiliary roller 47 is disposed on the upstream side of the second roller 46 by a predetermined distance. Each of the second rollers 46 is urged downward by a spring (not shown) and is always elastically pressed toward the first roller 45.

The first roller 45 is linked to the LF motor 71 via a power transmission mechanism and is driven by the LF motor 71 as the driving source. The first roller 45 includes the center axis 52, and the center axis 52 is supported by the main body frame 53 of the multi function device 10.

The second roller 46 is disposed on an upper side of the first roller 45. The first roller 45 may be formed by a single roller having an elongated columnar shape, or the first rollers 45 may be formed by eight rollers disposed to oppose the respective second rollers 46.

The first roller 45 is driven by the LF motor 71 to rotate forwardly and rearwardly, which allows the recording sheet to be conveyed toward the discharge tray 21 side and the reverse guide portion 16 side. Specifically, the recording sheet 103 conveyed along the conveying path 23 is nipped by the first roller 45 and the second roller 46. Then, when the first roller 45 rotates forwardly, the recording sheet 103 is conveyed to the downstream side in the conveying direction while the recording sheet 103 is nipped by the first roller 45 and the second roller 46, and then discharged to the discharge tray 21. On the other hand, when the first roller 45 rotates rearwardly, the recording sheet 103 is reversed to the upstream side in the conveying direction while the recording sheet 103 is nipped by the first roller 45 and the second roller 46.

In this embodiment, an outer diameter of the first roller 45 is set slightly larger than that of the discharge roller 62. That is, when the first roller 45 and the discharge roller 62 are driven to rotate at a same rotation velocity, a circumferential velocity of the first roller 45 is larger than that of the discharge roller 62. Therefore, when the recording sheet 103 is conveyed by both the discharge roller 62 and the first roller 45, the recording sheet 103 is always strained in the conveying direction.

Figure 7:
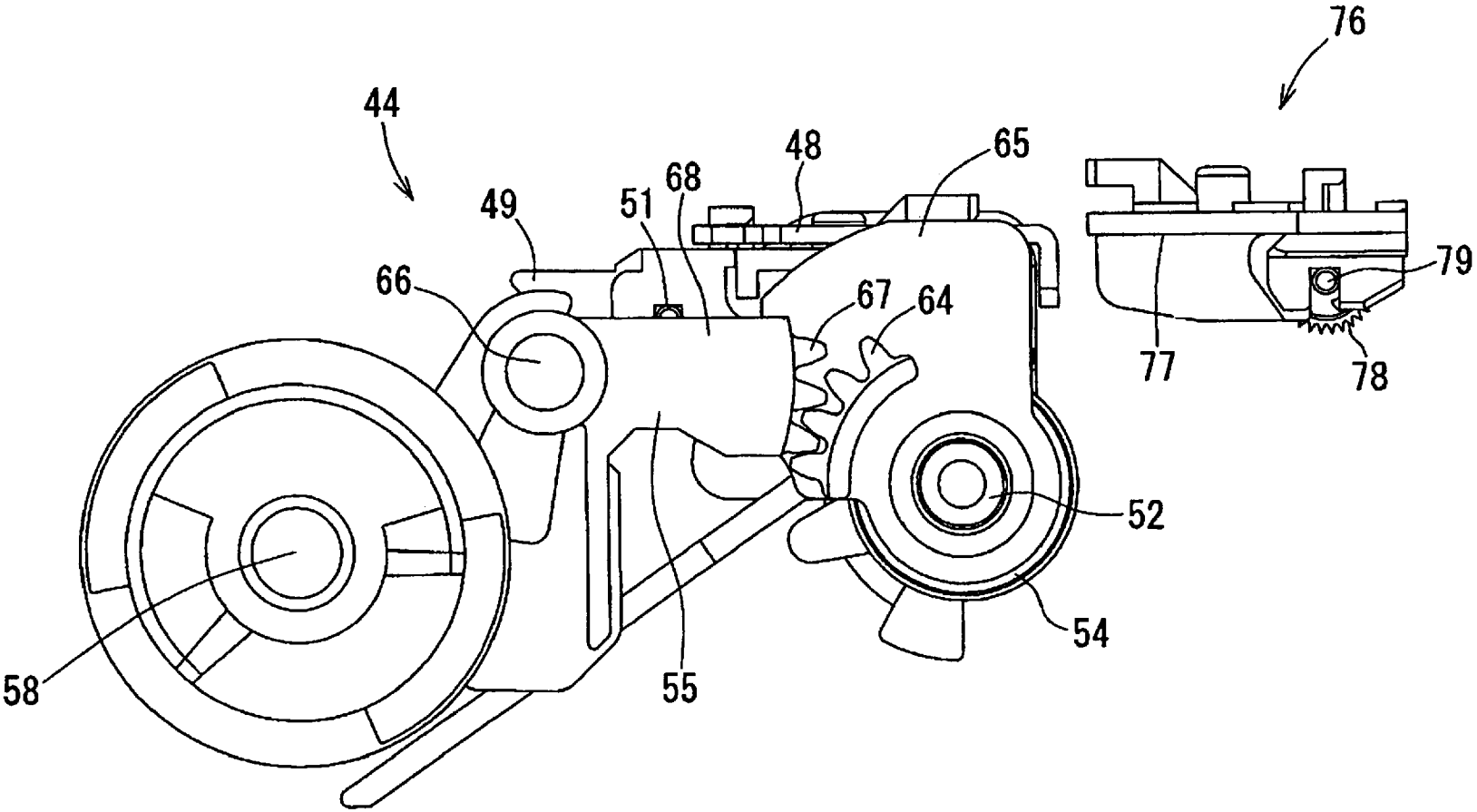
FIG. 7 is a diagram as viewed from a direction indicated by an arrow VII shown in FIG. 6.
Figure 8:
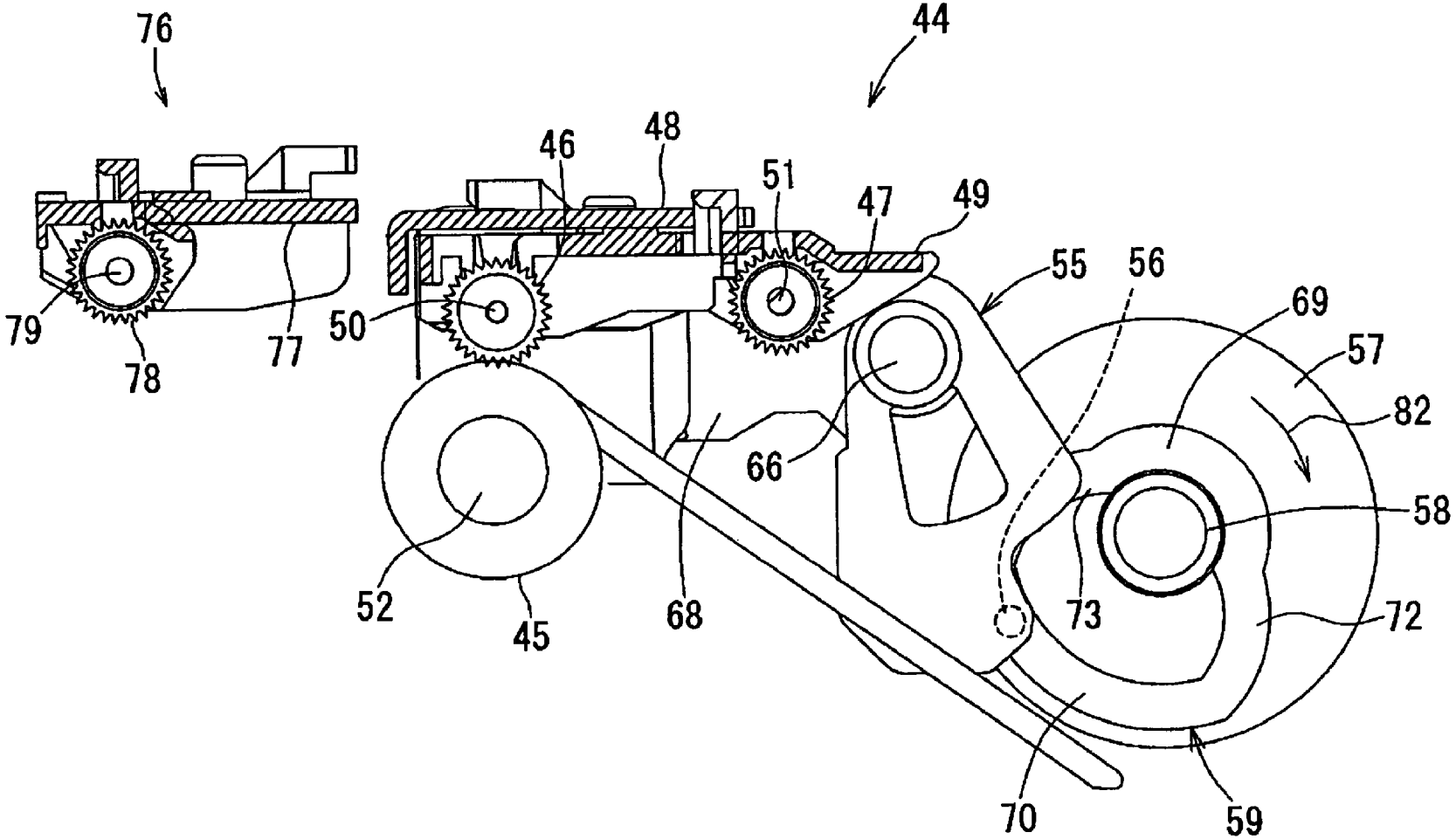
FIG. 8 is a diagram as viewed from a direction indicated by an arrow VIII shown in FIG. 6.

Here, a driving mechanism 44 of the path switching unit 41 is described with reference to FIGS. 6 to 8. FIG. 6 is a perspective view of the path switching unit 41. FIG. 7 is a diagram as viewed from a direction indicated by an arrow VII shown in FIG. 6. FIG. 8 is a diagram as viewed from a direction indicated by an arrow VIII shown in FIG. 6. The driving mechanism 44 is configured to: drive the path switching unit 41 from a state shown in FIG. 4 to a state shown in FIG. 5; and drive the path switching unit 41 to return back from the state shown in FIG. 5 to the state shown in FIG. 4.

As shown in FIG. 6, the driving mechanism 44 includes: a driven gear 54 provided at the center axis 52; a drive gear 55 meshing with the driven gear 54; and a cam 57 linked to the drive gear 55.

The cam 57 is coupled to one end of a rotation drive axis 58, and the rotation drive axis 58 is driven by the LF motor 71 as a driving source thereof. As shown in FIG. 8, a guide groove 59 is provided on the cam 57. The guide groove 59 is formed circularly around the rotation drive axis 58. Specifically, the guide groove 59 includes: a small arc portion 69 and a large arc portion which are formed around the rotation drive axis 58 as a center thereof; a connection groove 72 connecting one end of the small arc portion 69 and one end of the large arc portion 70; and a connection groove 72 connecting the other end of the small arc portion 69 and the other end of the large arc portion 70.

As shown in FIGS. 6 and 7, the driven gear 54 includes a toothed portion 64 and a flange portion 65. The toothed portion 64 is formed as an involute gear having the center axis 52 as a center thereof. The toothed portion 64 is fitted to the center axis 52 and is rotatable around the center axis 52. The flange portion 65 is formed integral with the toothed portion 64 and is connected to the frame 48. Therefore, when the toothed portion 64 rotates, the frame 48, the subframe 49, the second roller 46 and the auxiliary roller 47 can integrally rotate around the center axis 52.

The drive gear 55 is rotatably supported by a support shaft 66. The support shaft 66 is provided at the main body frame 53. The drive gear 55 includes a toothed portion 67 and an arm 68. The toothed portion 67 is formed as an involute gear having the support shaft 66 as a center thereof and meshes with the toothed portion 64. The arm 68 includes a pin 56 provided to protrude thereon. The pin 56 is fitted to the guide groove 59 and slidable along the guide groove 59. When the toothed portion 67 rotates, the toothed portion 64 also rotates. As a result, the frame 48, the subframe 49, the second roller 46 and the auxiliary roller 47 can integrally rotate around the center axis 52.

As shown in FIG. 8, when the cam 57 rotates, the pin 56 relatively moves along the guide groove 59. Particularly, when the pin 56 slides along the connection groove 72, 73, the pin 56 moves in a radial direction of the cam 57. Therefore, the cam 57 rotates clockwise (a direction shown by an arrow 82) in FIG. 8, the pin 56 moves in order of the large arc portion 70, the connection groove 72 and the small arc portion 69.

Therefore, the drive gear 55 rotates clockwise in FIG. 7. As a result, the driven gear 54 rotates counterclockwise around the center axis 52 in FIG. 7. As described above, the driven gear 54 is linked to the frame 48. Therefore, when the driven gear 54 rotates, the frame 48, the subframe 49, the second roller 46 and the auxiliary roller 47 integrally rotate around the center axis 52. When the cam 57 rotates in an opposite direction to the above-described direction from this state, the frame 48, the subframe 49, the second roller 46 and the auxiliary roller 47 integrally rotate around the center axis 52 so as to return back to the former state.

In this embodiment, a posture of the path switching unit 41 shown in FIG. 4 is referred to as a "recording medium discharging posture," and a posture of the path switching unit 41 shown in FIG. 5 is referred to as a "recording medium reversing posture." When the image is to be recorded only the front surface of the recording sheet, (i.e., single-sided recording), the path switching unit 41 always takes the recording medium discharging posture, and the recording sheet conveyed along the conveying path 23 is sent to the discharge tray 21 side (see FIG. 4).

On the other hand, when the posture of the path switching unit 41 is changed to the recording medium reversing posture, as shown in FIG. 5, the recording sheet 103 is guided to the reverse guide portion 16. Specifically, when images are to be recorded on both front and rear sides of the recording sheet, the posture of the path switching unit 41 is maintained in the recording medium discharging posture at first (see FIG. 4), and the recording sheet of which an image has been recorded on the front side is conveyed to the downstream side in the conveying direction. Thereafter, the posture of the path switching unit 41 is changed from the recording medium discharging posture (see FIG. 4) to the recording medium reversing posture (see FIG. 5), and the auxiliary roller 47 presses the recording sheet 103 and guides the recording sheet 103 to the reverse guide portion 16 side.

Turning back to FIG. 4, the description will be continued. On the downstream side of the path switching unit 41, a guide portion 76 is provided. The guide portion 76 is disposed on the downstream side of the first roller 45 and the second roller 46 in the conveying direction. A support plate 75 is attached to the main body frame 53, and the guide portion 76 is provided at the support plate 75.

The guide portion 76 includes: a base portion 77 fixed to a bottom face of the support plate 75; and a guide roller 78 supported by the base portion 77. The base portion 77 includes a support axis 79, and the guide roller 78 is rotatably supported by the support axis 79. In this embodiment, the guide roller 78 has a spur shape.

The guide portion 76 contacts a recording side of the recording sheet 103 when the first roller 45 and the second roller 46 rotate rearwardly and the recording sheet 103 is conveyed to the reverse guide portion 16. The guide portion 76 does not contact the recording sheet 103 when the first roller 45 and the second roller 46 rotate forwardly and the recording sheet 103 is conveyed to the reverse guide portion 16. Specifically, the guide portion 76 is disposed at a position which does not contact an imaginary line, the imaginary line connecting: a contact point of the first roller 45 and the second roller 46; and a contact point of the discharge roller 62 and the spur roller 63.

When a conveying direction of the recording sheet 103 is changed and then the recording sheet 103 is conveyed to the reverse guide portion 16, a part of the recording sheet 103 located in a downstream side of the first roller 45 and the second roller 46 acts on an orientation of the recording sheet 103 to extend along a direction parallel to the reverse guide portion 16 due to the rigidity of the recording sheet 103. However, the guide roller 78 contacts the recording side of the recording sheet 103 and makes the recording sheet 103 bend. Consequently, the recording sheet 103 is wrapped around the first roller 45 and the second roller 46 to exhibit a stable conveying force, so that the recording sheet 103 is reliably conveyed to the reverse guide portion 16.

Turning back again to FIG. 3, the description will be continued. The reverse guide portion 16 is connected to the conveying path 23. Specifically, the reverse guide portion 16 is continuous with the downstream portion 36 of the recording portion 24 in the conveying path 23. The reverse guide portion 16 defines a reversing path for guide the recording sheet of which the image has been recorded on the front surface again to the feeding tray 20.

The reversing path extends in obliquely downward direction from the downstream portion 36 of the conveying path 23 to the feeding roller 25. The reversing path is defined by: a first guide surface 32 defining an inner line; a second guide surface 33*a* disposed to oppose the first guide surface 32 with a predetermined interval so as to define an outer line in an upstream side; and a second guide surface 33*b* continuous with the second guide surface 33*a* to define an outer line in a downstream side. In this embodiment, the first guide surface 32 is defined by a surface of a guide member 34, the second guide surface 33*a* is defined by a surface of a guide member 35, and the second guide surface 33*b* is defined by a surface of a flap 37.

A front surface of the flap 37 is defined as the second guide surface 33*b*. The flap 37 supports the recording sheet, of which the image has been recorded on the front side, from an opposite side (rear side) of the recording sheet. The flap 37 also introduces the recording sheet to the feeding roller 25. The flap 37 is formed in a plate shape extending in an oblique downward direction from the downstream end of the guide member 35 to a near side of the feeding roller 25.

An upstream portion of the flap 37 is supported by a rotation axis 37*a*, and the flap 37 is rotatable around the rotation axis 37*a*. Consequently, the flap 37 can vertically move to and away from the feeding tray 20. Since both the feeding roller 25 and the flap 37 are rotatably supported, regardless of an amount of the recording sheets placed in the feeding tray 20, an interval between the feeding roller 25 and the flap 37 can be constantly maintained. Therefore, a feeding performance at a re-feeding of the recording sheet (the image has been recorded on the front surface thereof) conveyed on the flap 37 by the feeding roller 25 can be stabilized.

Further, the flap 37 is rotatably urged downward by its own weight or an urging member such as a spring (not shown). Therefore, the downstream end of the flap 37 is normally contacts the feeding tray 20 (or the recording sheet placed on the feeding tray 20) and is retracted upward when the feeding tray 20 is inserted and pulled out. Therefore, a portion of the recording sheets (the image is unrecorded thereon) placed in the feeding tray 20 which opposes the feeding roller is pressed at a predetermined pressure, and the unrecorded recording sheet can be reliably introduced to the feeding roller 25 without floating the recording sheet.

Figure 9:
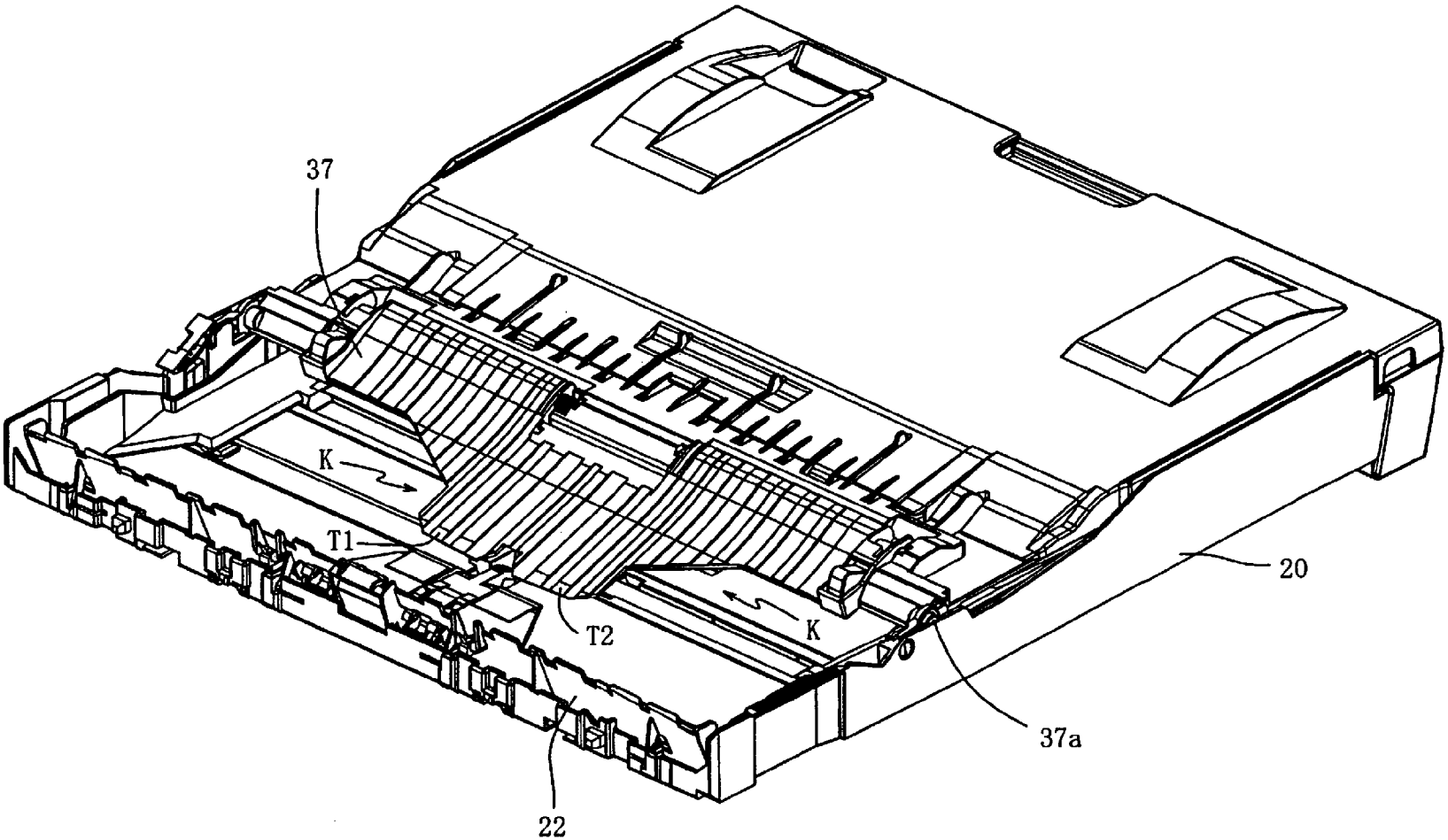
FIG. 9 is an external perspective view of a flap.
Figure 10:
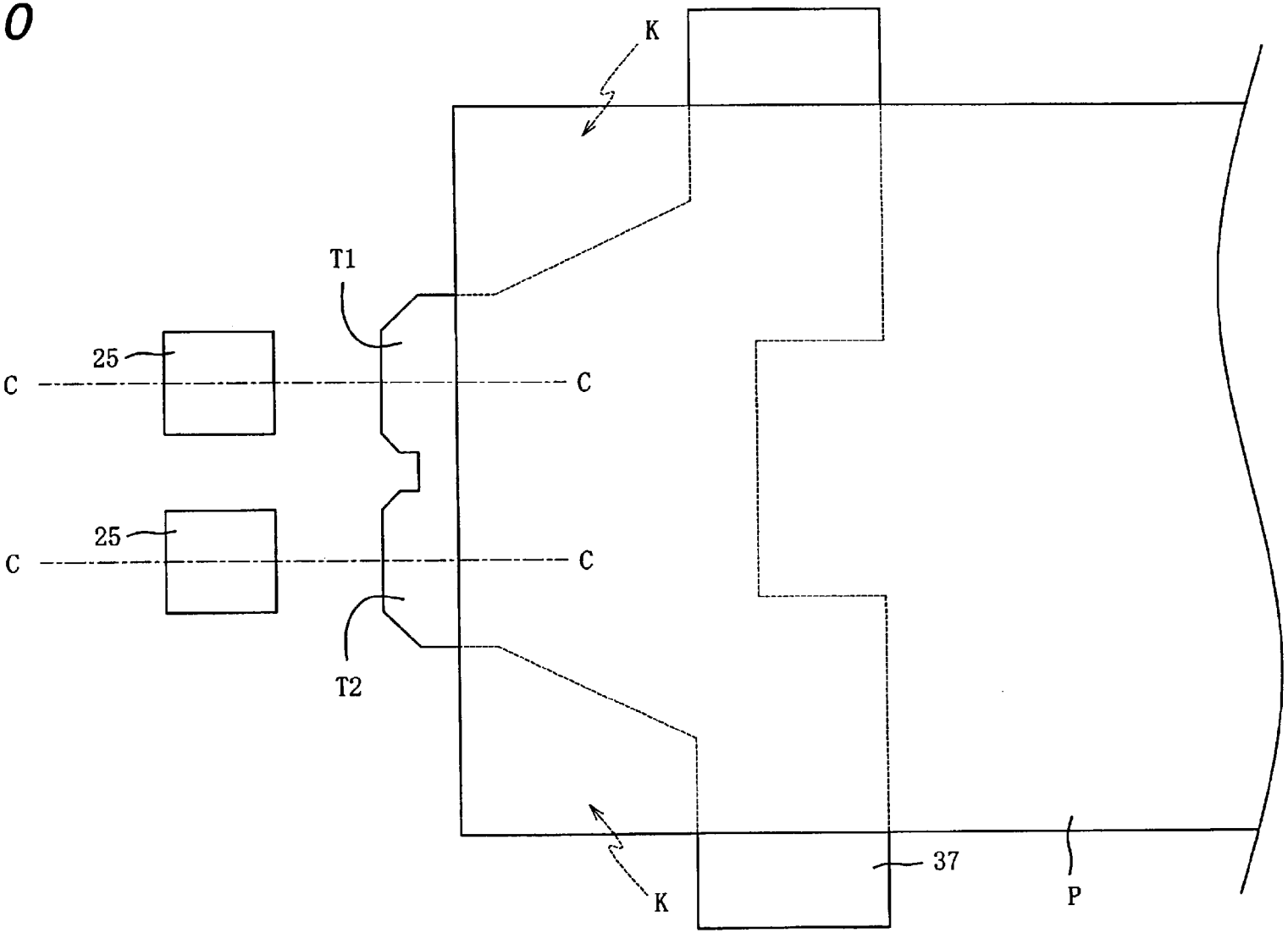
FIG. 10 is a plan view schematically showing a feeding roller, the flap, and a recording sheet.

Here, with reference to FIGS. 9 and 10, the flap 37 is specifically described. FIG. 9 is an external perspective view of the flap 37, and FIG. 10 is a schematic plan view of the feeding roller 25, the flap 37 and a recording sheet P conveyed on the flap 37.

As shown in FIG. 10, in a downstream end of the flap 37 in the conveying direction, an entire region except regions T1, T2 respectively opposing to the feeding rollers 25 (in this embodiment, two feeding rollers 25 are provided and spaced by predetermined interval) is cut out to form a cutout portion K.

Therefore, even when the recording sheet P is deformed due to a press-contact of the downstream end of the recording sheet P in the conveying direction with the feeding roller 25 in a state where a cockling of the recording sheet P (the image is recorded on the front surface thereof) conveyed on the flap 37 occurs, the pressure generated by the deformation of the recording sheet P can be released and absorbed by the cutout portion k. Therefore, it is possible to suppress the jam occurring when the recording sheet P is fed by the feeding roller 25, and the recording sheet P can be smoothly conveyed.

As shown in FIG. 10, a width of the each of the regions T1, T2 is progressively reduced such that width ends of each of the regions T1, T2 are progressively closer to a center line C of the corresponding feeding roller 25 opposing the region T1, T2 in a direction toward the feeding roller 25. In addition, the width of a distal end portion of each of the regions T1, T2 is substantially the same as that of the corresponding feeding roller 25 opposing the region T1, T2. Consequently, the inclination of the downstream end of the conveying direction of the flap 37 in a height direction due to part accuracy in the height direction can be reduced as much as possible. Further, the flap 37 can support the recording sheet on extension lines of the center lines C of the feeding rollers 25. Therefore, it is further possible to reliably suppress the jam when the recording sheet enters the feeding roller 25.

Further, as shown in FIG. 3, the downstream end of the flap 37 in the conveying direction is formed to be progressively thinned with respect to a height direction in a direction toward the feeding roller 25, the downstream end of the flap 37 in the conveying direction can be disposed as close to the feeding roller 25 as possible. Accordingly, the recording sheet can be reliably introduced to the feeding roller 25.

Figure 11:
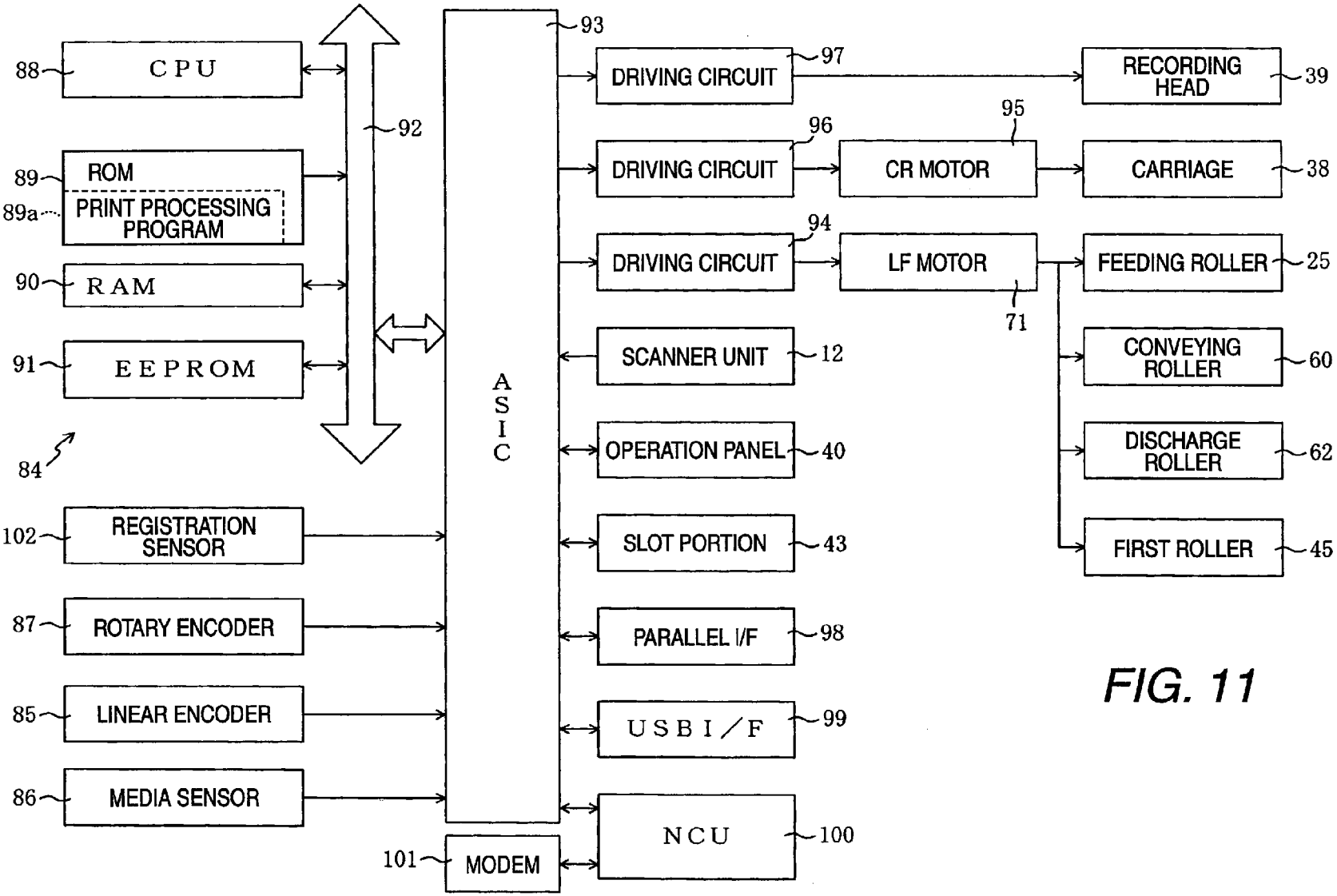
FIG. 11 is a block diagram showing a control unit of the multi function device.

Next, with reference to FIG. 11, a configuration of a control unit 84 of the multi function device 10 is described. FIG. 11 is a block diagram of the configuration of the control unit 84 of the multi function device 10. The control unit 84 is configured to control the entire operation of the multi function device 10 including the scanner unit 12 in addition to the printer unit 11. However, in this embodiment, the detailed description relating to the scanner unit 12 is omitted.

As shown in FIG. 11, the control unit 84 is configured as a microcomputer mainly including a CPU (Central Processing Unit) 88; a ROM (Read Only Memory) 89; a RAM (Random Access Memory) 90; an EEPROM (Electrically Erasable and Programmable ROM) 91 capable of storing the settings or flags to be retained even after the power is OFF, and is connected to an ASIC (Application Specific Integrated Circuit) 93 via a bus 92.

The ROM 89 stores thereon, for example, a program for enabling a computer (e.g., the control unit 84) to control various operations of the multi function device 10. For example, a print processing program 89*a* enables the control unit 84 to execute a print processing shown in FIG. 12. The RAM 90 is used as a memory area temporally storing various data used for executing the above programs by the CPU 88 or a work area.

The ASIC 93 generates signals such as a phase excitation signal for energizing the LF motor 71 based on command from the CPU 88, and the generated signal is applied to a driving circuit 94 of the LF motor 71. The rotation of the LF motor 71 is controlled by applying the driving signal to the LF motor 71 via the driving circuit 94.

The driving circuit 94 is configured to drive the LF motor 71 that is connected to the feeding roller 25, the conveying roller 60, the discharge roller 62 and the first roller 45. The driving circuit 94 generates an electric signal for rotating the LF motor 71 based on the output signal from ASIC 93. The LF motor 71 rotates based on the electric signal, and a rotation force of the LF motor 71 is transmitted to the feeding roller 25, the conveying roller 60, the discharge roller 62 and the first roller 45 via a driving mechanism including a gear and a driving axis.

In the multi function device 10, the LF motor 71 serves as the driving sources: for feeding the recording sheet from the feeding tray 20; for conveying the recording sheet positioned on the platen 42 or discharging the recording sheet which has recorded to the discharge tray 21; and for driving the discharge roller 62 via a predetermined power transmission mechanism.

That is, the LF motor 71 drives: the conveying roller 60; the feeding roller 25 via the power transmission mechanism 27; and the discharge roller 62 via the predetermined power transmission mechanism. The predetermined power transmission mechanism may include a gear train, or may use a timing belt or the like in light of an assembly space.

The ASIC 93 generates signals such as a phase excitation signal for energizing the CR (carriage) motor 95 based on command from the CPU 88, and the generated signal is applied to a driving circuit 96 of the CR motor 95. The rotation of the CR motor 95 is controlled by applying the driving signal to the CR motor 95 via the driving circuit 96.

The driving circuit 96 is configured to drive the CR motor 95 connected the carriage 38. The driving circuit 96 generates an electric signal for rotating the CR motor 95 based on the output signal from the ASIC 93. The CR motor 95 rotates based on the electric signal, and a rotation force of the CR motor 95 is transmitted to the carriage 38. Consequently, the carriage 38 reciprocates.

A driving circuit 97 allows the recording head 39 to selectively eject the ink at selected timings to the recording sheet. The driving circuit 97 drive-controls the recording head 39 based on the output signal generated by the ASIC 93 based on the drive control procedure output from CPU 88.

The ASIC 93 is connected with the operation panel for operating and instructing the scanner unit 12 and the multi function device 10, the slot portion 43 to which various compact memory cards can be inserted, a parallel interface (I/F) 98 and a USB interface (I/F) 99 for communicating with external devices such as a personal computer via a parallel cable and a USB cable, respectively, and a NCU (Network Control Unit) 100 and a modem (MODEM) 101 for enabling the facsimile function.

The ASIC 93 is also connected to the registration sensor 102 configured to detect a conveyance of the recording sheet conveyed from the feeding roller 25 in the vicinity of the conveying roller 60, the rotary encoder 87 configured to detect rotation amounts of respective rollers driven by the LF motor 71, the linear encoder 85 configured to detect a travel distance of the carriage 38, and the media sensor 86 to detect a presence or absence of the recording sheet on the platen 42.

Here, the process executed by the control unit 84 of the multi function device 10 is briefly described. When the multi function device 10 is powered on, the carriage 38 once moves to an end of a slidable area, and a detection position detected by the linear encoder 85 is initialized. In accordance with a sliding movement of the carriage 38 from an initial position, an optical sensor 107 provided at the carriage 38 detects the pattern of the encoder strip.

The control unit 84 obtains the travel distance of the carriage 38 using the number of the pulse signal based on the detection of the optical sensor 107. The control unit 84 controls the CR motor 95 to allow the reciprocation of the carriage 38 to be controlled based on the obtained travel distance. Further, the control unit 84 obtains a position of the leading end and/or the trailing end of the recording sheet and also obtains a conveying distance of the recording sheet, based on the output signal of the registration sensor 102 and an encoding amount detected by the rotary encoder 87.

The control unit 84 controls the LF motor 71 to intermittently convey the recording sheet by a linefeed width when the leading end of the recording sheet reaches a predetermined position of the platen 42. The line feed width is set based, for example, on a resolution which is input as a condition for the image recording. Especially, when the high resolution recording (specifically, a borderless photo recording) is performed, the control unit 84 precisely detect the leading end and/or the trailing end of the recording sheet based on the presence/absence of the recording sheet detected by the media sensor 86 and the encoding amount detected by the rotary encoder 87.

Further, the control unit 84 precisely detects the both side ends of the recording sheet based on the presence/absence of the recording sheet detected by the media sensor 86 and the encoding amount detected by the encoder the linear encoder 85. The control unit 84 controls the ejection of ink drops from the inkjet recording head 39 based on the positions of the leading end, the trailing end and both side ends of the recording medium detected accordingly.

Figure 12:
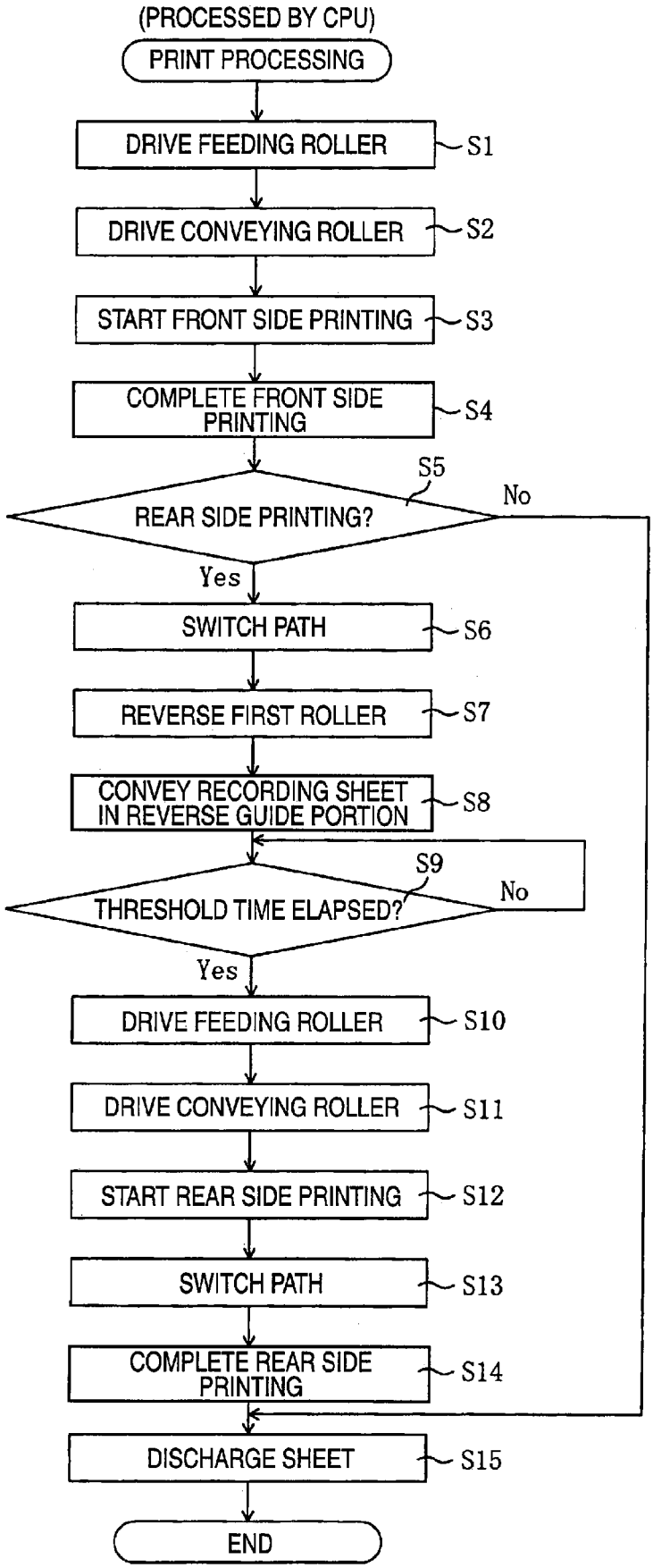
FIG. 12 is a flowchart showing a printing operation.

Next, the print processing executed by the CPU 88 of the multi function device 10 is described with reference to FIG. 12. FIG. 12 is a flowchart showing the print processing executed by the CPU 88 of the multi function device 10.

In the print processing, when an instruction to execute the print is input, the feeding roller 25 is driven (S1) to convey the recording sheet from the feeding tray 20 to the conveying path 23. In this case, the recording sheet placed on the feeding tray 20 is pressed by the regions T1, T2 in the downstream end portion of the flap 37 in the conveying direction, the regions T1, T2 opposing the feeding rollers 25. Therefore, floating of the recording sheet is suppressed, and the recording sheet is reliably fed by the feeding roller 25. On feeding the recording sheet by the feeding roller 25, the recording sheet is inversed in the conveying path 23 such that an opposing side of the recording medium to a side having contacted the feeding roller 25 opposes a nozzle formation of the recording head 39.

Then, the recording sheet is detected by the registration sensor 102, and the conveying roller 60 is driven after a threshold time period elapses from when the recording sheet reaches the conveying roller 60 and the pinch roller 31, in order to adjust an oblique conveyance of the recording sheet (S2). The recording sheet is nipped by the conveying roller 60 and the pinch roller 31, and then conveyed to a space between the recording head 39 and the platen 42 by the conveying roller 60 and the pinch roller 31. Thereafter, the image recording of a side of the recording medium opposing the recording head 39 starts (S3).

In this case, the conveying roller 60 and the pinch roller 31 intermittently conveys the recording sheet, and the recording head 39 records an image on the front side of the recording sheet in a state where the recording sheet stops.

When the recording sheet reaches the discharge roller 62 and the spur roller 63, the discharge roller 62 and the spur roller 63 are driven to convey the recording sheet to a further downstream side by the discharge roller 62 and the spur roller 63. When the recording sheet reaches the first roller 45 and the second roller 46, the first roller 45 and the second roller 46 are driven to convey the recording sheet to a further downstream side by the first roller 45 and the second roller 46. During the above operations, the image recording of the front side of the recording sheet completes (S4).

Next, it is determined which image recording mode is set, the single-sided recording mode or the double-sided recording mode (S5). The image recording mode is preliminary set by the user by using the operation panel 40 or the like. The data designating the single-sided recording mode or the double-sided recording mode is transmitted from the operation panel 40 to the RAM 90 of the control unit 84, and the data is stored on the RAM 90.

Instead, the data designating the single-sided recording mode may be stored on the ROM 89 in advance as a default value. In this case, the control unit 84 reads the data designating the double-sided recording mode from the RAM 90 or the ROM 89, and the image is recorded also on the rear side of the recording sheet.

When the single-sided recording mode is set by operating the operation panel 40 by the user (S5: No), after the image is recorded on the front side of the recording sheet (S4), the first roller 45 and the second roller 46 are continuously driven to convey the recording sheet to the downstream side in the conveying direction. Consequently, the recording sheet is discharged on the discharge tray 21 (S15) When the single-sided recording mode is set, the posture of the path switching unit 41 is always maintained to the recording medium discharging posture (see FIG. 4).

On the other hand, when the double-sided recording mode is set by operating the operation panel 40 by the user (S5: Yes), after the image is recorded on the front side of the recording sheet (S4), the first roller 45 and the second roller 46 are once stopped, and the path switching unit 41 is driven to change the posture to the recording medium reversing posture (see FIG. 5) (S6).

When the posture of the path switching unit 41 is changed to the recording sheet reversing posture, the path switching unit 41 is rotated around the center axis of the first roller 45. That is, the second roller 46 rolls over the circumferential surface of the first roller 45 while the second roller 46 nips the recording sheet, and the recording sheet is pressed by the auxiliary roller 47.

In other words, the second roller 46 rolls over the circumferential surface of the first roller to wrap the recording sheet around the circumferential surface of the first roller 45. Accordingly, the auxiliary roller 47 presses the recording sheet from the front side of the recording sheet toward the reverse guide portion 16, and an upstream end portion (the trailing end of the front side, the leading end of the rear side) of the recording sheet enters the reverse guide portion 16 (see FIG. 5).

Thereafter, the first roller 45 and the second roller 46 are rotated rearwardly (S7), and the recording sheet is conveyed toward the feeding roller 25 in the reverse guide portion 16 (S8). Consequently, the recording sheet is conveyed on the second guide surfaces 33*a*, 33*b* toward the feeding roller 25.

Then, the end portion (the trailing end of the front side, the leading end of the rear side) of the recording sheet reaches the feeding roller 25. At this time, the feeding roller 25 is not driven immediately, and it is determined whether a threshold time period elapses (S9) Until the threshold time period elapses (S9: No), the process of S9 is repeated, and the first roller 45 and the second roller 46 are continuously rotated rearwardly until the threshold time period elapses. Consequently, the oblique conveyance of the recording sheet is adjusted, and the re-feeding performance by the feeding roller 25 can be improved.

When or after the threshold time period elapses (S9: Yes), the feeding roller 25 is driven (S10). When the feeding roller 25 is driven, the feeding roller 25 and the first and second rollers 45, 46 are simultaneously driven such that the conveying distance of the recording sheet by the feeding roller 25 is smaller than that by the first roller 45 and the second roller 46. Consequently, the recording sheet can be conveyed in the reverse guide portion 16 while the recording sheet is in a bent state.

As compared with a case of conveying the recording sheet without bend, the conveying load of the feeding roller 25 is reduced, and the feeding roller 25 hardly slips. Accordingly, it is possible to suppress damage to the image recorded on the front side of the recording sheet due to the slip of the feeding roller 25 which causes the image to be transferred to the feeding roller 25 since the front side of the recording sheet contacts the feeding roller 25.

In the downstream end portion of the flap which is positioned on the near side of the feeding roller 25, the entire region except the regions T1, T2 respectively opposing the feeding rollers 25 is cut out and is formed as the cutout portion k.

Therefore, even when the recording sheet is deformed due to a press-contact of the downstream end of the recording sheet P in the conveying direction by the feeding roller 25 in a state where a cockling of the recording sheet (the image is recorded on the front surface thereof) conveyed on the flap 37 occurs, the pressure generated by the deformation of the recording sheet can be released and absorbed by the cutout portion k. Therefore, it is possible to suppress the jam occurring when the recording sheet is fed by the feeding roller 25.

Figure 13:
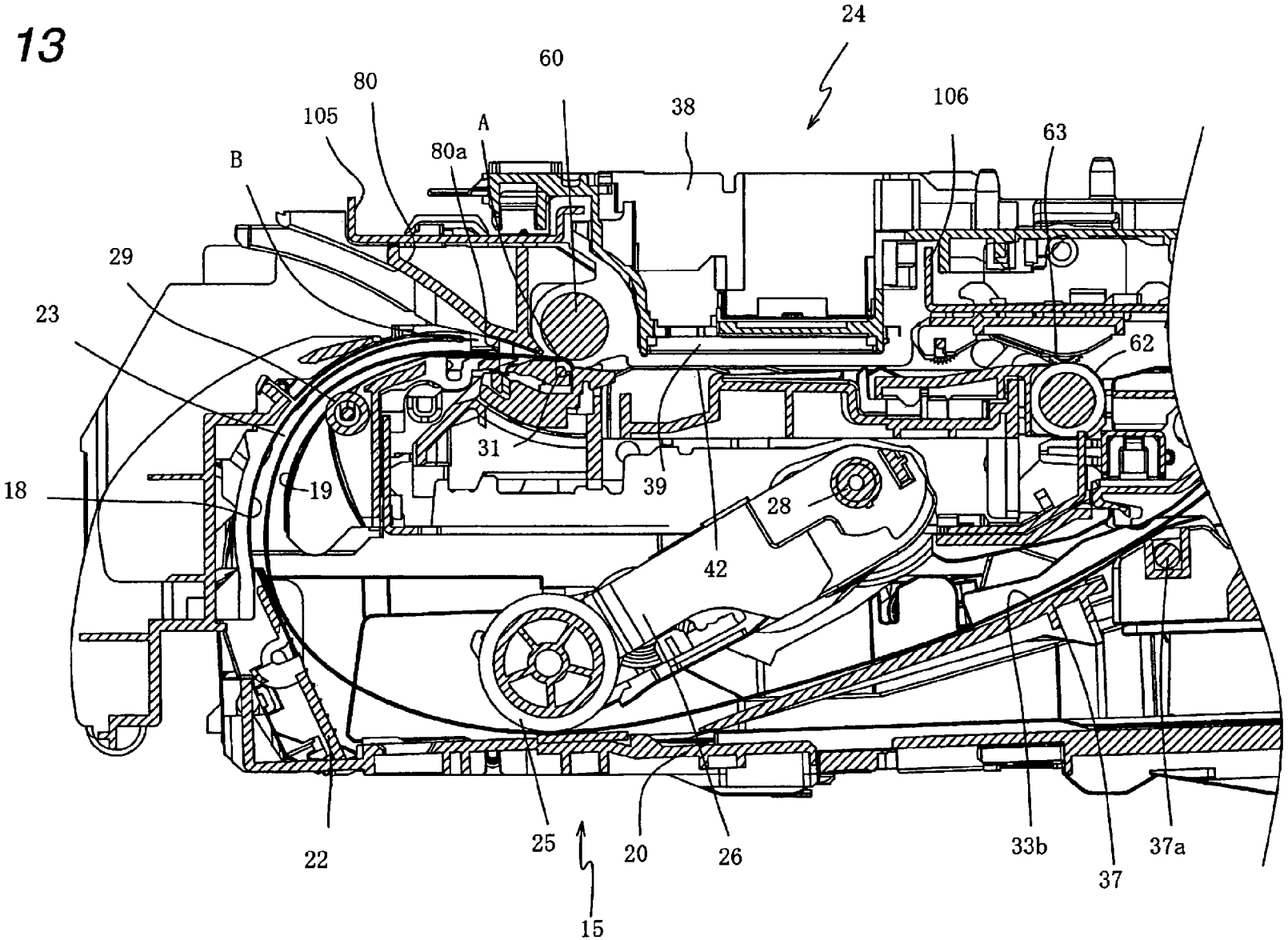
FIG. 13 is an enlarged cross-sectional view of a portion from the feeding roller to a conveying roller.
Figure 14:
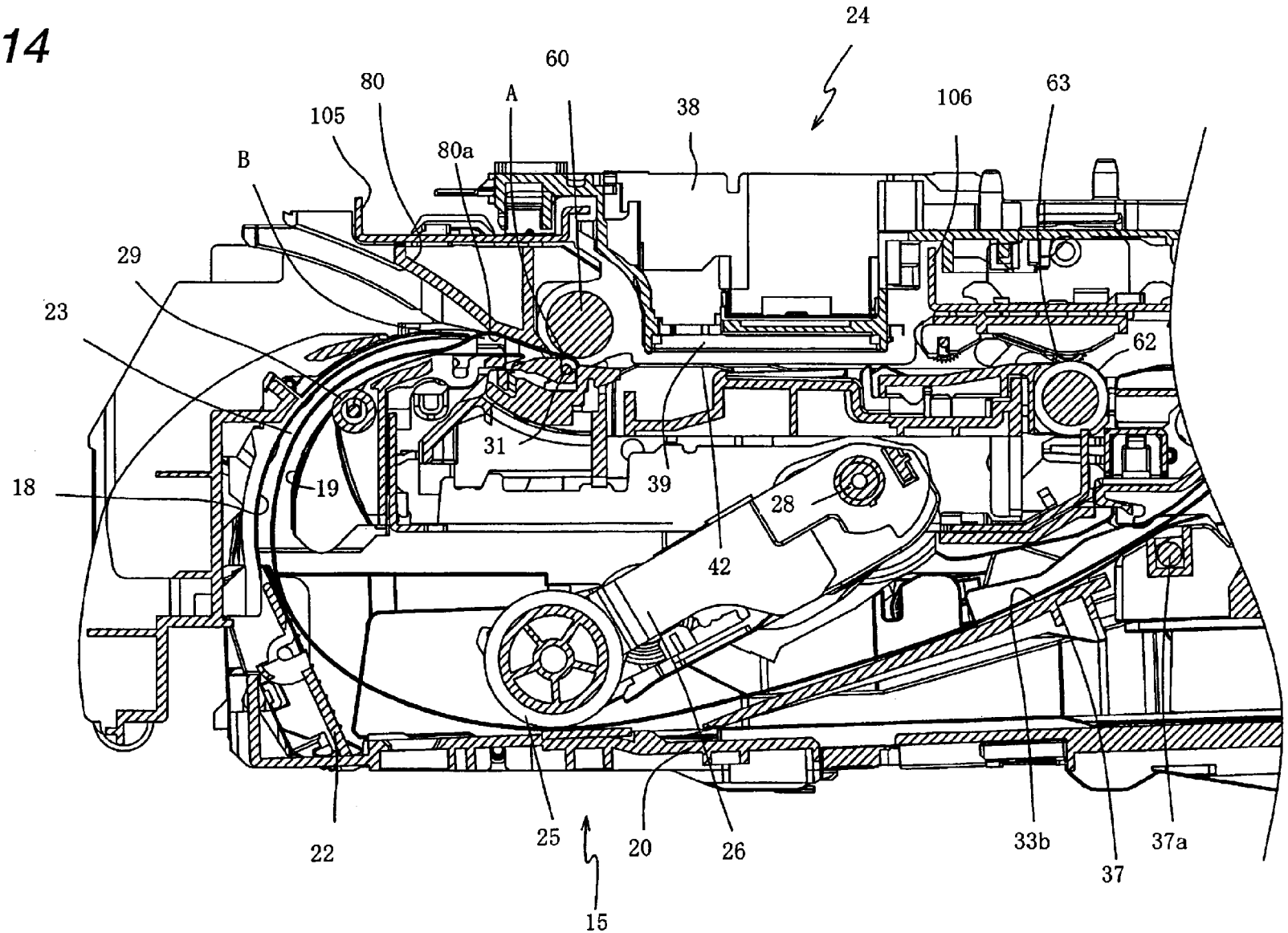
FIG. 14 is an enlarged cross-sectional view of the portion from the feeding roller to the conveying roller.
Figure 15:
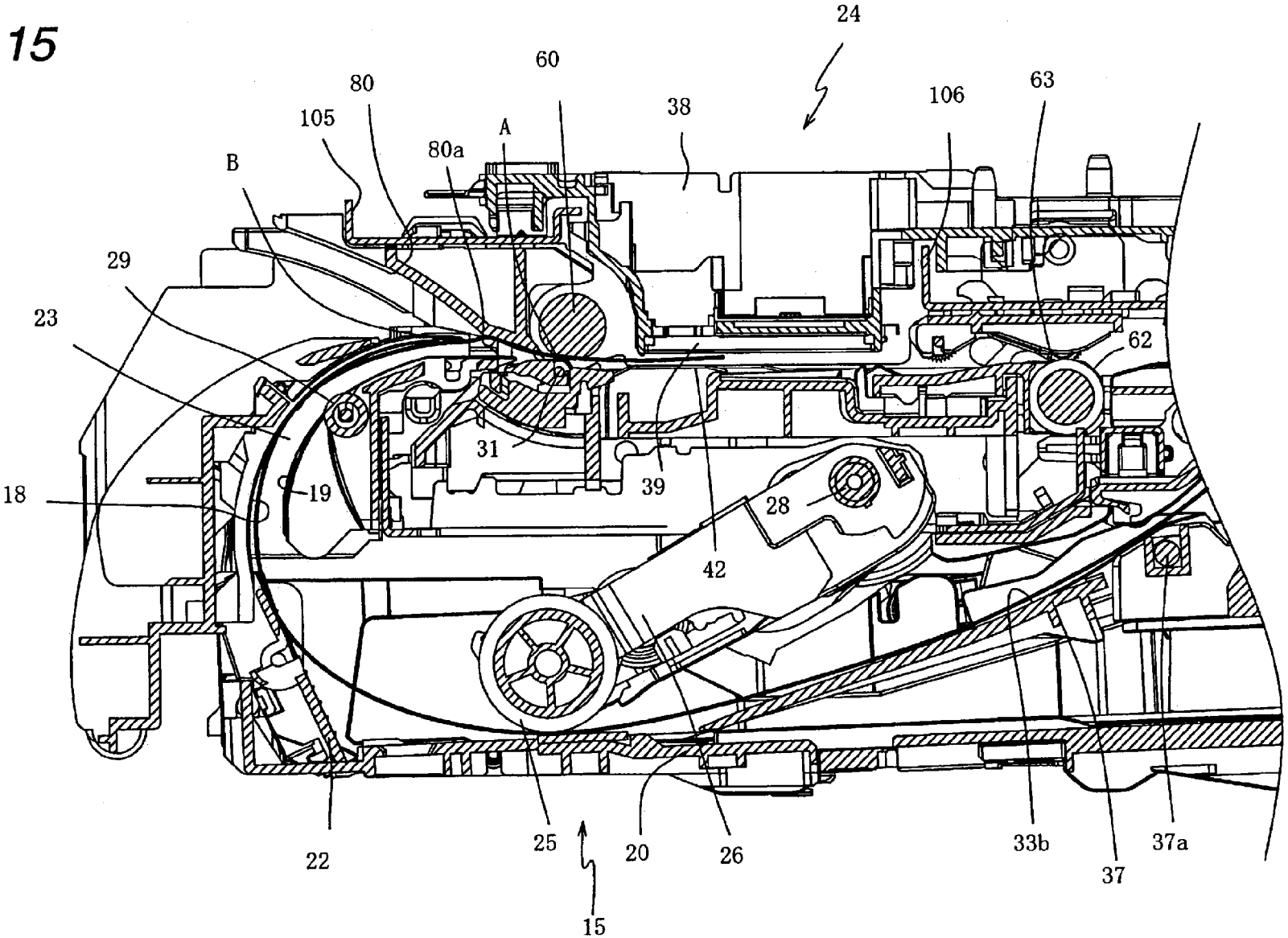
FIG. 15 is an enlarged cross-sectional view of the portion from the feeding roller to the conveying roller.

Next, the process after the feeding roller is driven by the process of S10 is described with reference to FIG. 13 to FIG. 15. FIGS. 13 to 15 are enlarged cross-sectional views of a portion from the feeding roller 25 to the conveying roller 60.

When the feeding roller 25 is driven (S10), the recording sheet P is inversed in the conveying path 23 via the separation inclined plate 22 such that an side (the rear side) of the recording sheet P opposing to a side (front side) contacting the feeding roller 25 opposes to the nozzle formation of the recording head 39, as shown in FIG. 13. The recording sheet is detected by the registration sensor 102. When the recording sheet reaches the conveying roller 60 and the pinch roller 31 and after the threshold time period elapsed, the conveying roller 60 is driven in order to adjust the oblique conveyance of the recording sheet (S11).

That is, even when the recording sheet reaches the conveying roller 60 and the pinch roller 31, the conveying roller 60 is not driven immediately, and during this period, the feeding roller 25 is continuously driven. Therefore, the recording sheet P is bent toward the guide surface 80*a* as shown in FIG. 14, and the oblique conveyance of the recording sheet is adjusted while the recording sheet contacts the guide surface 80*a*. The buckling space for absorbing the bend can be secured in the space B defined between the downstream end of the outer guide surface 18 and the guide 80.

When the conveying roller 60 and the pinch roller 31 are driven after the threshold time period elapses (S11), the recording sheet is conveyed by controlling the LF motor 71 such that the conveying velocity of the feeding roller 25 is larger than that of the conveying roller 60. In other words, the LF motor 71 is controlled such that the traveling distance of the recording sheet by the feeding roller 25 per unit time is larger than the traveling distance of the recording sheet by the conveying roller 60 per unit time. Accordingly, the conveying load at the conveying roller 60 is reduced, and it is possible to suppress the slip of the conveying roller 60.

By controlling the feeding roller 25 and the conveying roller 60 in this way, the recording sheet is conveyed along the outer guide surface 18 of the conveying path 23 as shown in FIG. 15. Thereafter, the recording sheet contacts the guide surface 80*a*, and is conveyed along the guide surface 80*a* toward the press-contact position A of the conveying roller 60 and the pinch roller 31. Consequently, the recording sheet is conveyed on the platen 42.

That is, the conveying direction of the recording sheet is regulated by the guide surface 80*a* such that the recording sheet enters toward the press-contact position A of the conveying roller 60 and the pinch roller 31. Therefore, the recording sheet is stably conveyed to the platen 42, and it is possible to suppress the floating of the recording sheet on the platen 42. Therefore, it is possible to prevent: the jam of the recording sheet between the recording head 39 and the platen 42; the stain of the recording sheet due to the contact of the recording sheet with the recording head 39; and the deterioration of the recording quality caused by an uneven interval between the recording head 39 and the recording sheet.

In this embodiment, the LF motor 71 is controlled such that the conveying velocity of the feeding roller 25 is larger than that of the conveying roller 60 at the process of S11, and this control process is not executed at S2. In other words, the control of the conveying velocity is executed only when the rear side of the recording sheet is printed.

This is because that the recording sheet of which the image has been recorded on the front side tends to deform due to the swell of the ink ejected on the recording sheet as compared with the recording sheet of which the image is unrecorded on both sides. Therefore, the conveying roller 60 and the pinch roller 31 are likely to slip. In view of this, the conveying velocity control is not executed when the recording sheet of which the image is unrecorded on the both sides is conveyed, and the conveying velocity control is executed only when the recording sheet of which the image has been recorded on the front side is conveyed. Accordingly, the conveying velocity control can be simplified when the recording sheet on which the image is unrecorded on the both sides is conveyed.

Accordingly, when the recording sheet is conveyed by the conveying roller 60 and the pinch roller 31 on the platen 42, similar to the above, the image is recorded on the rear side of the recording sheet by the recording head 39 (S12). Then, the path switching unit 41 is driven such that the posture of the path switching unit 41 is changed from the recording medium reversing posture (see FIG. 5) to again the recording sheet discharging posture (see FIG. 4), before the leading end of the recording sheet (the leading end of the rear side of the recording sheet) enters the path switching unit 41 (S13). The image recording on the rear side of the recording sheet is completed (S14), and the recording sheet of which the images have been recorded on both sides is conveyed to the downstream side in the conveying direction by the first roller 45 and the second roller 46. At this time, the first roller 45 and the second roller 46 is rotated forwardly, and the recording sheet is discharged on the discharge tray 21 (S15).

Figure 16:
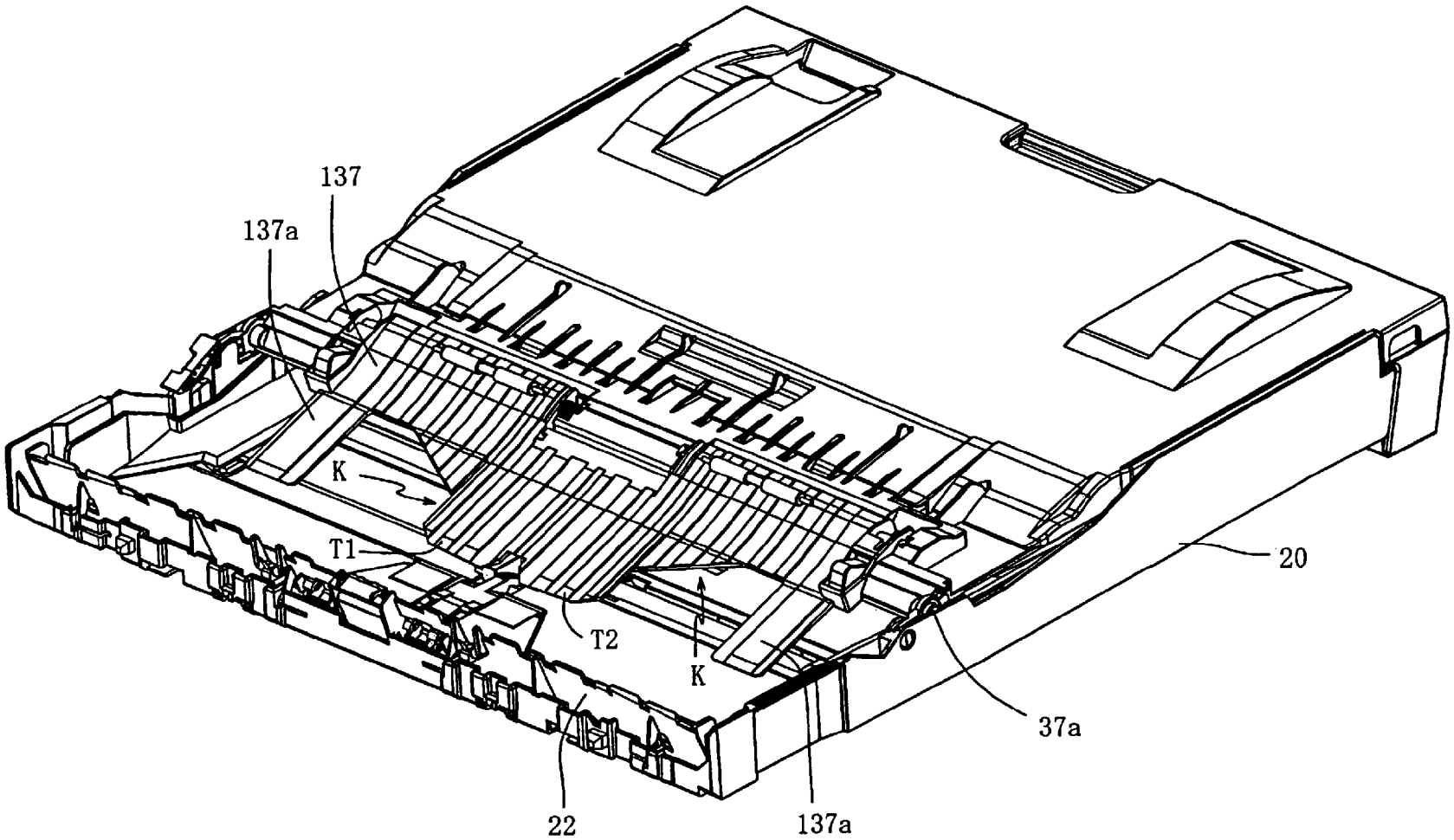
FIG. 16 is an external perspective view of a flap according to a second embodiment.

Next, the second embodiment regarding the flap 37 is described with reference to FIG. 16. FIG. 16 is an external perspective view of a flap 137 according to the second embodiment. The same symbols respectively denote the same elements to the first embodiment, and the detailed description thereof is omitted.

In the flap 37 of the first embodiment, the cutout portion k is provided in the entire region except the regions T1, T2 opposing the feeding rollers 25 (in the embodiments, two feeding rollers 25 are provided and spaced with a predetermined interval) in the downstream end portion of the flap 37 in the conveying direction.

In the flap 137 of the second embodiment, the cutout portions k are formed between the region T1 and a side flap 137*a* and between the region T2 and a side flap 137*a*, which is not in the entire region (see FIG. 10) except the regions T1, T2 opposing the feeding rollers 25 in the downstream end portion of the flap 137 in the conveying direction. That is, the flap 137 of the second embodiment is different from the flap 37 of the first embodiment in that the flap 137 includes the side flaps 137*a* provided at end portions of the flap 137 in the width direction.

Accordingly, the flap 137 of the second embodiment includes the side flaps 137*a*. Therefore, for example, when the double-side printing is set unavailable to a recording sheet having a size in which edge of sheet width (i.e., the edge extending along the conveying direction) is placed on the side flap 137*a*, it is not necessary to provide the cutout portion k at the entire region except the regions T1, T2 of the flap 37. Therefore, the rigidity of flap 137 can be secured by providing the side flap 137*a* without cutting out the portion corresponding to the side flap 137*a*.

Although the above description was given according to embodiments of the present invention, the present invention is not limited thereto. It is a matter of course that various modes of carrying out the principles disclosed herein may be adopted without departing from the spirit and scope of the claims appended hereto.

In the above-described embodiments, the widths at the distal ends of the regions T1, T2 of the flap 37 are substantially the same as the widths of the feeding rollers 25. However, the width of the distal end of each of the regions T1, T2 may be smaller than the width of the corresponding feeding roller 25, while the center of the width of the distal end of each of the regions T1, T2 locates on the extension line of the center line C of the corresponding feeding roller 25.

The cross-sectional shape of the flap 37 at each of the regions T1, T2 along the width direction may have V-shape which is convex toward the feeding tray. In this case, each of the regions T1, T2 of the flap 37 linear-contacts the recording sheet placed on the feeding tray 20. Accordingly, the inclination of the flap 37 in the height direction due to due to the part accuracy can be further reduced, and the jam can be prevented more reliably.

In the above-described embodiments, the flap 37 is arranged to extend from the upstream side to the near side of the feeding roller 25 in the conveying direction such that the feeding roller 25 for feeding the unrecorded recording sheet placed on the feeding tray 20 also feeds the recording sheet of which the image has been recorded on the front side again to the recording head 39. However, if the apparatus includes, in addition to the feeding roller 25, a re-feeding roller configured to convey the recording sheet on which the image has been recorded on the front side again to the recording head 39, the flap 37 may be provided with respect to the re-feeding roller.

In the above-described embodiments, when the recording sheet of which the image has been recorded on the front side is conveyed by the feeding roller 25 and the conveying roller 60, the conveying velocity control is executed. However, the conveying velocity control may also be executed when the recording sheet of which the image is unrecorded on both sides is conveyed by the feeding roller 25 and the conveying roller 60.

What is claimed is:

1. An image recording apparatus capable of recording images on both sides of a recording medium, said image recording apparatus comprising:

a recording head configured to eject ink to the recording medium;

a re-feeding roller configured to re-feed a one-side recorded medium toward the recording head, the one-side recorded medium of which an image has been recorded on one side by the recording head; and a flap provided on an upstream side of the re-feeding roller in a conveying direction of the one-side recorded medium, the flap extending from an upstream end to a downstream end in the conveying direction, the downstream end of the flap being closer to the re-feeding roller than the upstream end of the flap in the conveying direction, and the flap being configured to support and introduce the one-side recorded medium to the re-feeding roller, wherein a downstream end portion of the flap has: a first region opposing the re-feeding roller; and a second region except the first region in the downstream end portion, the downstream end portion having a cutout portion provided in at least a part of the second region.

2. The image recording apparatus according to claim 1, wherein the cutout portion is provided in an entire portion of the second region of the downstream end portion of the flap.

3. The image recording apparatus according to claim 1, wherein a thickness of the downstream end portion of the flap is progressively reduced in a direction toward the re-feeding unit.

4. The image recording apparatus according to claim 1, wherein a width of the downstream end portion is progressively reduced in a direction toward the re-feeding unit.

5. The image recording apparatus according to claim 4, wherein the width of the downstream end portion is progressively reduced in the direction toward the re-feeding unit, such that a width end of the downstream end portion of the flap is positioned progressively closer to a width center in the direction toward the re-feeding unit.

6. The image recording apparatus according to claim 1, further comprising:

a tray on which a plurality of unrecorded media having no image recorded thereon are allowed to be stacked; and an arm that is rotatably supported and that supports the re-feeding roller on one end side of the arm to allow the re-feeding roller to contact the unrecorded medium placed on the tray, wherein the flap is rotatably supported to allow the downstream end portion to contact the unrecorded medium placed on the tray.

7. The image recording apparatus according to claim 1, further comprising:

a switch back roller provided on a downstream side of the recording head and an upstream side of the flap in the conveying direction and being configured to convey the one-side recorded medium to the flap, such that the one side of the one-side recorded medium having the image recorded thereon faces in a direction opposite to the flap and contacts the re-feeding roller.

* * * * *